US011454246B2

(12) United States Patent
Tsuchida et al.

(10) Patent No.: US 11,454,246 B2
(45) Date of Patent: Sep. 27, 2022

(54) ELECTRIC BLOWER, VACUUM CLEANER, AND HAND DRYING DEVICE

(71) Applicant: Mitsubishi Electric Corporation, Tokyo (JP)

(72) Inventors: Kazuchika Tsuchida, Tokyo (JP); Naho Adachi, Tokyo (JP)

(73) Assignee: Mitsubishi Electric Corporation, Tokyo (JP)

( * ) Notice: Subject to any disclaimer, the term of this patent is extended or adjusted under 35 U.S.C. 154(b) by 402 days.

(21) Appl. No.: 16/606,800

(22) PCT Filed: Jun. 22, 2017

(86) PCT No.: PCT/JP2017/022989
§ 371 (c)(1),
(2) Date: Oct. 21, 2019

(87) PCT Pub. No.: WO2018/235221
PCT Pub. Date: Dec. 27, 2018

(65) Prior Publication Data

US 2020/0318646 A1 Oct. 8, 2020

(51) Int. Cl.
*F04D 25/06* (2006.01)
*F04D 29/28* (2006.01)
(Continued)

(52) U.S. Cl.
CPC ..... *F04D 29/281* (2013.01); *F04D 25/082* (2013.01); *F04D 29/056* (2013.01);
(Continued)

(58) Field of Classification Search
CPC .. F04D 25/0606; F04D 25/082; F04D 29/281; F04D 29/4226; F04D 29/4253; F04D 29/441; F04D 29/5806
See application file for complete search history.

(56) References Cited

U.S. PATENT DOCUMENTS 2,658,665 A * 11/1953 Tschudy ..... F04D 29/441 417/423.2
2010/0054969 A1 3/2010 Grasmuck
(Continued)

FOREIGN PATENT DOCUMENTS

JP S62-070697 A 4/1987
JP H11-336696 A 12/1999
(Continued)

OTHER PUBLICATIONS

Extended European Search Report dated May 15, 2020 issued in corresponding EP patent application No. 17914605.5.
(Continued)

*Primary Examiner* — Ninh H. Nguyen
(74) *Attorney, Agent, or Firm* — Posz Law Group, PLC

(57) ABSTRACT

An electric blower includes an air blowing unit including a mixed-flow fan to generate a current of air, a motor to rotate the mixed-flow fan, and a housing including a first portion surrounding the mixed-flow fan in a circumferential direction, and a second portion surrounding the motor in the circumferential direction. The inner diameter of the second portion is smaller than the inner diameter of the first portion.

19 Claims, 25 Drawing Sheets

(51) Int. Cl.

| | |
|---|---|
| ***F04D 25/08*** | (2006.01) |
| *F04D 29/056* | (2006.01) |
| *F04D 29/42* | (2006.01) |
| *F04D 29/58* | (2006.01) |

(52) U.S. Cl.
CPC ..... *F04D 29/4253* (2013.01); *F04D 29/5806* (2013.01); *F05B 2250/502* (2013.01)

(56) References Cited

U.S. PATENT DOCUMENTS

| | | | | |
|---|---|---|---|---|
| 2013/0236303 | A1* | 9/2013 | Teramoto | F04D 17/08 415/206 |
| 2014/0328684 | A1* | 11/2014 | King | F04D 29/056 416/95 |
| 2016/0032938 | A1 | 2/2016 | Hayamitsu | |
| 2016/0341219 | A1* | 11/2016 | Li | F04D 29/4226 |
| 2017/0054352 | A1 | 2/2017 | Li et al. | |
| 2018/0177373 | A1* | 6/2018 | Hayamitsu | F04D 29/281 |
| 2018/0245601 | A1 | 8/2018 | Hayamitsu et al. | |

FOREIGN PATENT DOCUMENTS

| | | | | | |
|---|---|---|---|---|---|
| JP | 2000-175847 | A | | 6/2000 | |
| JP | 2000-249098 | A | | 9/2000 | |
| JP | 2000316747 | A | * | 11/2000 | |
| JP | 2005-307985 | A | | 11/2005 | |
| JP | 2011-052591 | A | | 3/2011 | |
| JP | 2012-202282 | A | | 10/2012 | |
| JP | 2013024134 | A | | 2/2013 | |
| JP | 2013-079625 | A | | 5/2013 | |
| JP | 2014-015853 | A | | 1/2014 | |
| JP | 2016-033352 | A | | 3/2016 | |
| WO | WO-2011027519 | A1 | * | 3/2011 | F04D 29/023 |
| WO | 2017/082222 | A1 | | 5/2017 | |

OTHER PUBLICATIONS

International Search Report of the International Searching Authority dated Sep. 5, 2017 for the corresponding international application No. PCT/JP2017/022989 (and English translation).

Office Action dated Feb. 4, 2022, in connection with counterpart European Patent Application No. 17914605.5.

* cited by examiner

ELECTRIC BLOWER, VACUUM CLEANER, AND HAND DRYING DEVICE

CROSS REFERENCE TO RELATED APPLICATION

This application is a U.S. national stage application of International Patent Application No. PCT/JP2017/022989 filed on Jun. 22, 2017, the disclosure of which is incorporated herein by reference.

TECHNICAL FIELD

The present invention relates to an electric blower.

BACKGROUND

An electric blower including a blade as a moving blade, and a motor to drive the blade is generally used. When the blade and the motor are surrounded by a housing, for example, it is possible to form, between the housing and the motor, a vent path (air path) as a path through which an air current generated by the moving blade passes. In, for example, an electric blower disclosed in patent reference 1, a semiconductor element is disposed in a vent path formed between a brushless motor and an outer casing serving as a housing. With this arrangement, a proposal is made to cool the semiconductor element by an air current passing through the vent path, and downsize the electric blower.

PATENT REFERENCE

Patent Reference 1: Japanese Patent Application Publication No. H11-336696 (see FIG. 3)

However, in an electric blower having a structure in which the width of a portion covering a motor is equal to or larger than the width (the width in the radial direction) of a portion covering a moving blade, a pressure loss is likely to occur when a current of air (to be also referred to as an air current hereinafter) generated by the moving blade flows to the downstream side of the moving blade. An increase in pressure loss causes a reduction in aerodynamic efficiency of the electric blower.

SUMMARY

It is an object of the present invention to provide an electric blower having high aerodynamic efficiency.

An electric blower according to an aspect of the present invention includes an air blowing unit including a mixed-flow fan to generate a current of air, a permanent magnet synchronous motor to rotate the mixed-flow fan, a housing including a first opening, a second opening communicating with the first opening, a first portion surrounding the mixed-flow fan in a circumferential direction, a second portion surrounding the permanent magnet synchronous motor in the circumferential direction, and a third portion provided between the first portion and the second portion. The permanent magnet synchronous motor includes a guide portion provided inside the third portion in a radial direction and to guide the air in a second direction, and an inner diameter of the second portion is smaller than an inner diameter of the first portion.

According to the present invention, an electric blower having high aerodynamic efficiency can be provided.

EMBODIMENT 1

Figure 1:
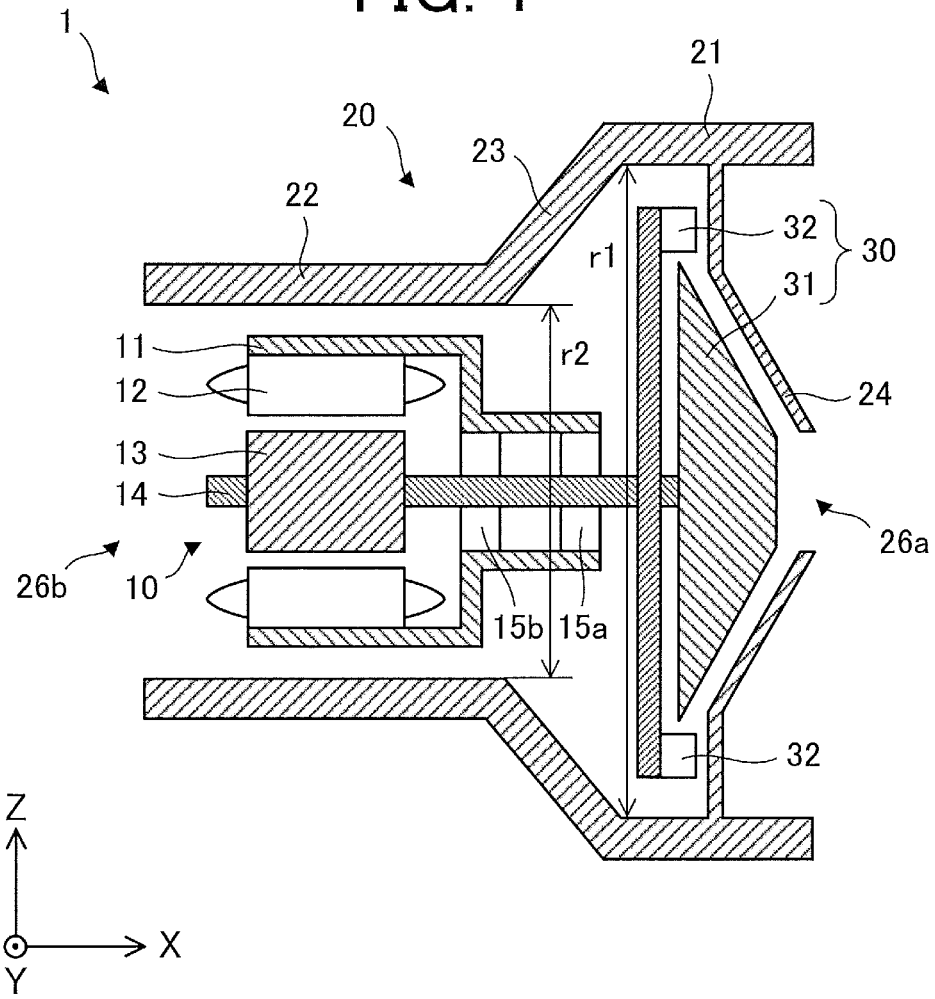
FIG. 1 is a sectional view schematically illustrating a structure of an electric blower according to Embodiment 1 of the present invention.
Figure 2:
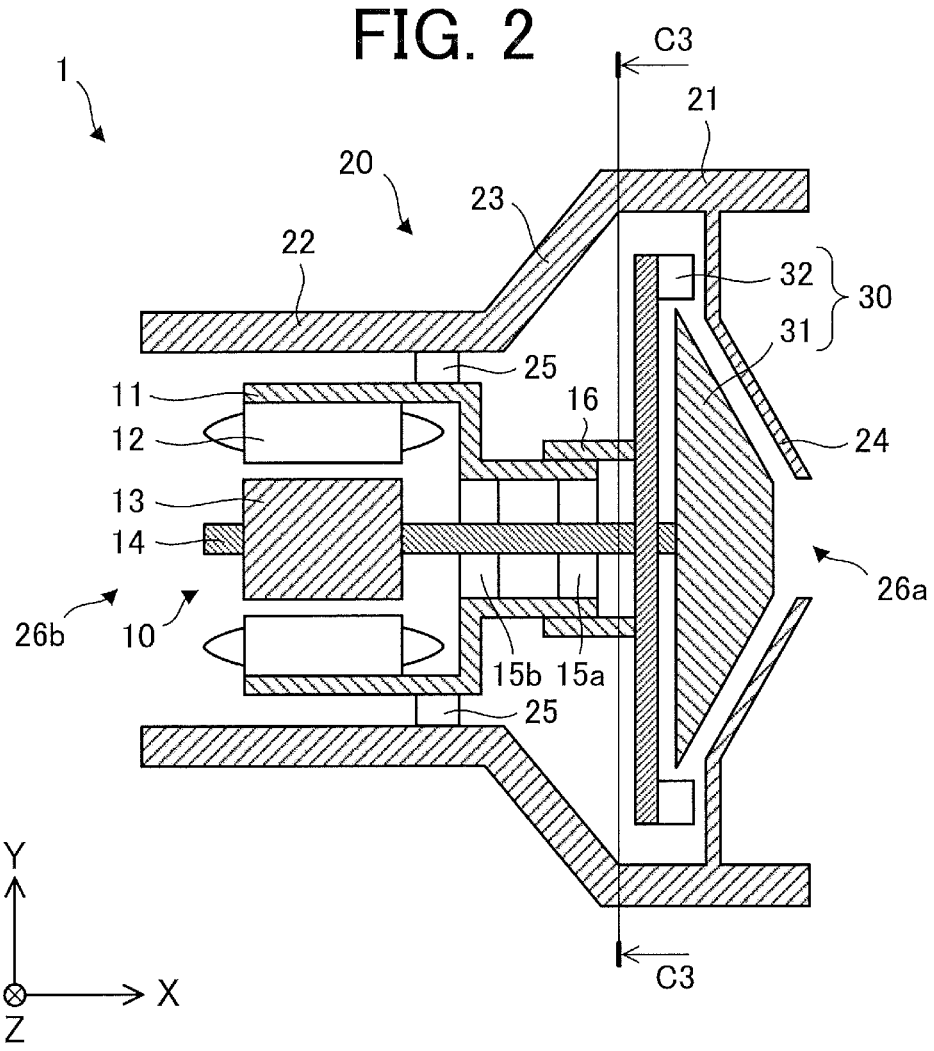
FIG. 2 is a diagram illustrating a state that the electric blower illustrated in FIG. 1 is rotated in the circumferential direction.

FIGS. 1 and 2 are sectional views schematically illustrating a structure of an electric blower 1 according to Embodiment 1 of the present invention. More specifically, FIG. 2 is a diagram illustrating a state that the electric blower 1 illustrated in FIG. 1 is rotated in the circumferential direction. The "circumferential direction" means the direction indicated by an arrow D1 illustrated in FIG. 3, and it is, for example, a rotation direction of a moving blade 31.

The electric blower 1 includes a motor 10, a housing 20, and an air blowing unit 30. The motor 10 is, for example, a permanent magnet synchronous motor. As the motor 10, however, a motor other than the permanent magnet synchronous motor may be used. The permanent magnet synchronous motor means a synchronous motor including a permanent magnet (ferromagnet), which is used for a field magnet.

The motor 10 includes a motor frame 11 (also simply called a frame), a stator 12, a rotor 13, a shaft 14, bearings 15*a* and 15*b*, and a stationary blade support portion 16 (FIG. 2).

The housing 20 includes a first portion 21, a second portion 22, a third portion 23, a fourth portion 24, a motor support portion 25, a first opening 26*a*, and a second opening 26*b* communicating with the first opening 26*a*.

The air blowing unit 30 includes a moving blade 31 that rotates and a stationary blade 32 that does not rotate. The air blowing unit 30 generates a current of air. The moving blade 31 is, for example, a mixed-flow fan. However, the moving blade 31 is not limited to the mixed-flow fan. The mixed-flow fan means a fan to generate an air current in a direction inclined with respect to the axis of rotation of the moving blade. The moving blade 31 rotates in accordance with rotation of the motor 10 (more specifically, the rotor 13 and the shaft 14).

The stator 12 is fixed to the interior (inner wall) of the motor frame 11. The rotor 13 is rotatably inserted inside the stator 12 with a gap in between. One end of the shaft 14 is fixed to a shaft hole formed in the rotor 13. The other end of the shaft 14 is rotatably inserted into the bearings 15*a* and 15*b* and fixed to the moving blade 31. The stationary blade support portion 16 is fixed to the motor frame 11 and supports the stationary blade 32.

The housing 20 has a cylindrical shape. In other words, the interior of the housing 20 is hollow. The first portion 21 surrounds the moving blade 31 in the circumferential direction. The second portion 22 surrounds the motor 10 in the circumferential direction. The third portion 23 is provided between the first portion 21 and the second portion 22. The third portion 23 is formed integrally with the first portion 21 and the second portion 22. The fourth portion 24 is formed to face the moving blade 31, and forms the first opening 26*a*. The fourth portion 24 is formed integrally with the first portion 21. The motor support portion 25 supports the motor 10.

Figure 3:
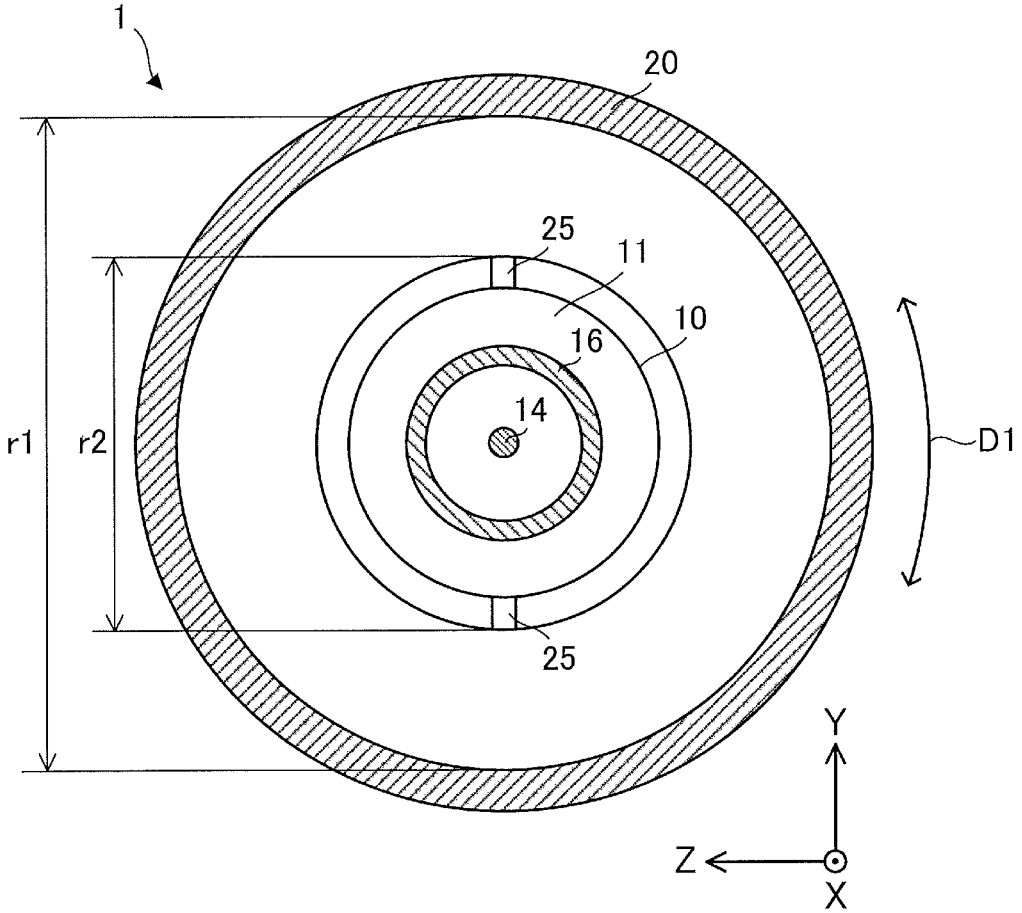
FIG. 3 is a sectional view taken along a line C3-C3 in FIG. 2.

FIG. 3 is a sectional view taken along a line C3-C3 in FIG. 2.

The inner diameter r2 of the second portion 22 is smaller than the inner diameter r1 of the first portion 21, as illustrated in FIGS. 1 and 3.

A current of air in the electric blower 1 will be described below.

Figure 4:
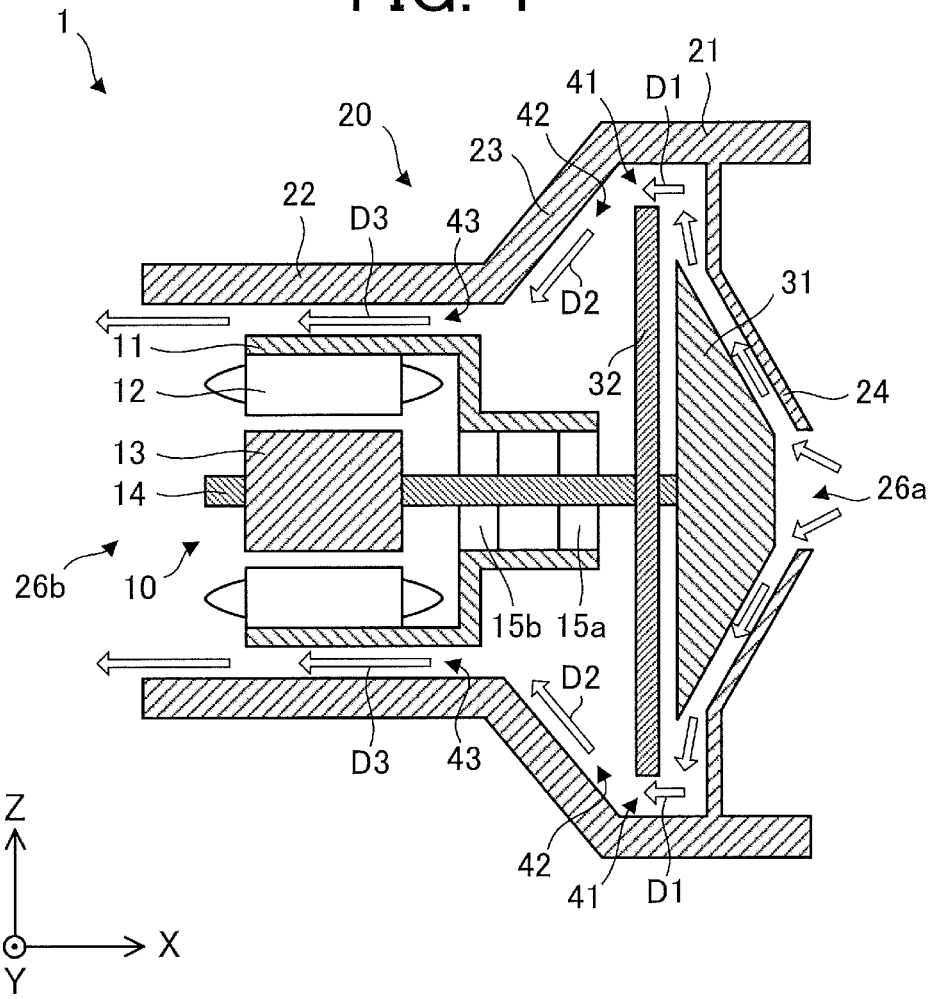
FIG. 4 is a diagram illustrating a current of air generated by rotation of a moving blade in the electric blower.

FIG. 4 is a diagram illustrating a current of air generated by rotation of the moving blade 31 in the electric blower 1.

The electric blower 1 includes a first path 41 through which air passes, a second path 42 through which the air having passed through the first path 41 passes, and a third path 43 through which the air having passed through the second path 42 passes. The first path 41 is formed between the housing 20 (more specifically, the first portion 21) and the air blowing unit 30 (more specifically, the stationary blade 32). The second path 42 is formed between the first path 41 and the third path 43. The third path 43 is formed between the housing 20 (more specifically, the second portion 22) and the motor 10 (more specifically, the motor frame 11).

When the electric blower 1 is powered on, power is supplied to the motor 10 and the motor 10 rotates the moving blade 31. The rotation of the moving blade 31 generates an air current in the electric blower 1. More specifically, air passes through the first opening 26*a* from outside the electric blower 1 and flows into the electric blower 1. During rotation of the moving blade 31, the air flows toward the second opening 26*b*.

More specifically, the air current generated by the moving blade 31 passes through the stationary blade 32 and flows into the first path 41. In the first path 41, the air flows in a first direction D1. The first direction D1 is a direction parallel to the shaft 14. In the example illustrated in FIG. 4, the first direction D1 is a direction from the first opening 26*a* to the second opening 26*b* and a direction parallel to the X-axis. However, the first direction D1 need not always be exactly parallel to the shaft 14.

The air having passed through the first path 41 flows into the second path 42. In the second path 42, the air flows in a second direction D2. The second direction D2 is along the inner surface of the third portion 23 on the X-Z plane. In the example illustrated in FIG. 4, the second direction D2 is a direction from the first opening 26*a* to the second opening 26*b* and a direction along the inner surface of the third portion 23.

The air having passed through the second path 42 flows into the third path 43. The third path 43 is formed between the second portion 22 and the motor 10. In the third path 43, the air flows in a third direction D3. The third direction D3 is a direction parallel to the shaft 14. In the example illustrated in FIG. 4, the third direction D3 is a direction from the first opening 26*a* to the second opening 26*b* and a direction parallel to the X-axis. In other words, in the example illustrated in FIG. 4, the first direction D1 and the third direction D3 are parallel to each other. However, the third direction D3 need not always be exactly parallel to the shaft 14.

The air having passed through the third path 43 is exhausted outside the electric blower 1 from the second opening 26*b*.

Modification 1.

Figure 5:
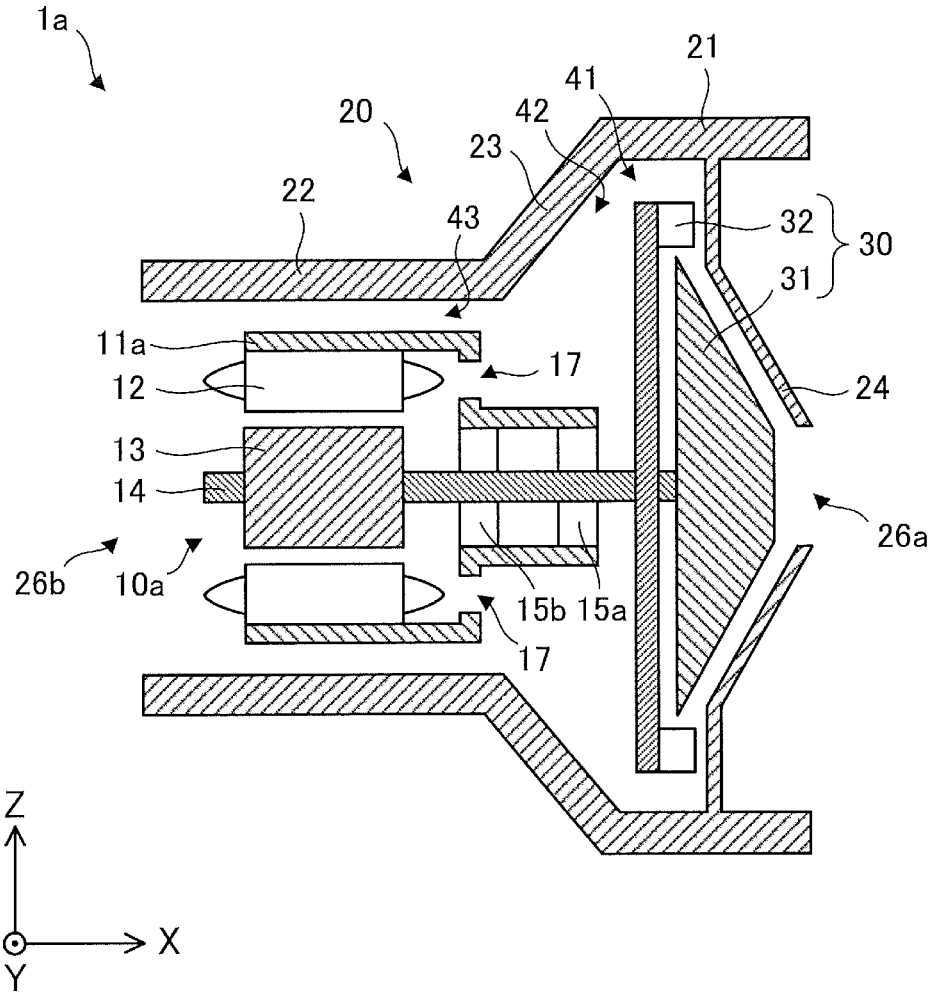
FIG. 5 is a sectional view schematically illustrating a structure of an electric blower according to Modification 1 to Embodiment 1.

FIG. 5 is a sectional view schematically illustrating a structure of an electric blower 1*a* according to Modification 1 to Embodiment 1.

The electric blower 1*a* according to Modification 1 is different from the electric blower 1 according to Embodiment 1 in that a motor frame 11*a* of a motor 10*a* includes a through hole 17, and these two electric blowers are the same in other respects.

At least one through hole 17 for cooling the motor 10*a* (more specifically, the interior of the motor 10*a*) is formed at an end of the motor frame 11*a* in the rotation axis direction (the X-axis direction in FIG. 5). During rotation of the moving blade 31, the air having passed through the second path 42 flows into the third path 43 and further flows into the interior of the motor frame 11*a* through the through hole 17. The air having flowed into the interior of the motor frame 11*a* passes through a through hole (air path) formed in the stator 12 and the air gap between the rotor 13 and the stator 12, and is exhausted outside the motor 10*a*. This makes it possible to cool the motor 10*a*, and to improve the stability of the electric blower 1*a*.

Modification 2.

Figure 6:
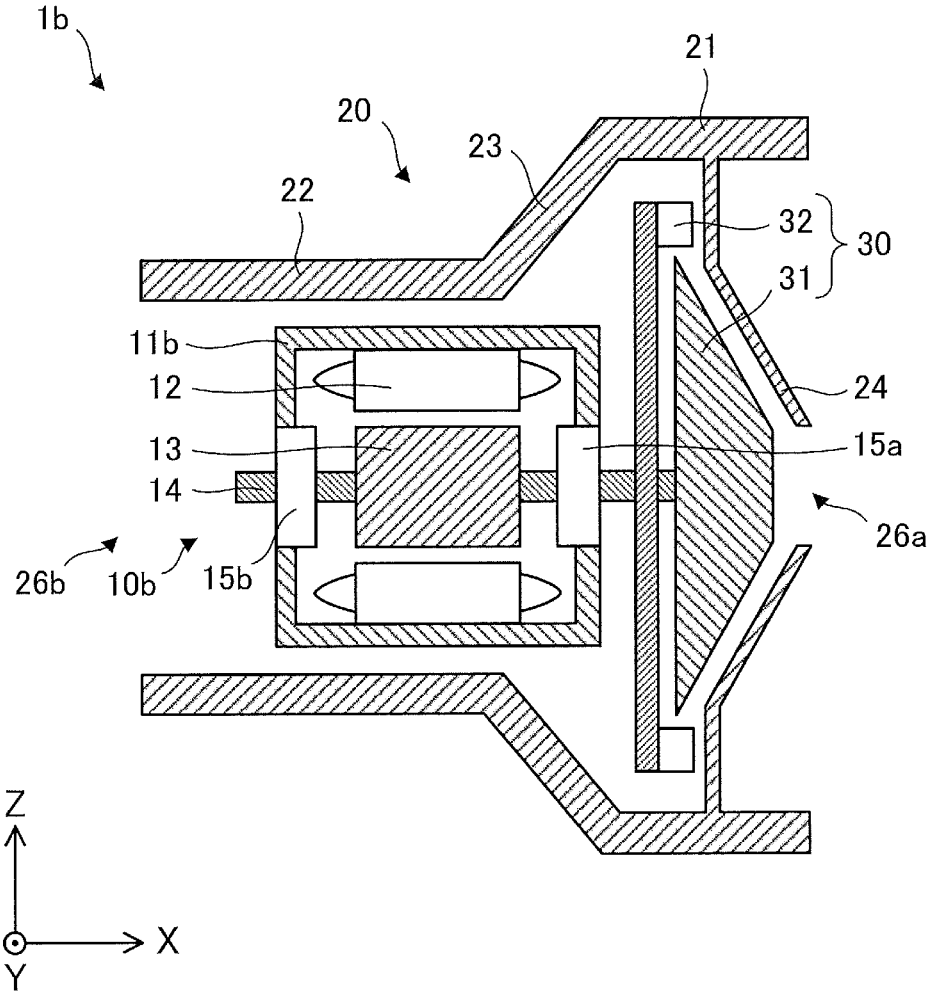
FIG. 6 is a sectional view schematically illustrating a structure of an electric blower according to Modification 2 to Embodiment 1.
Figure 7:
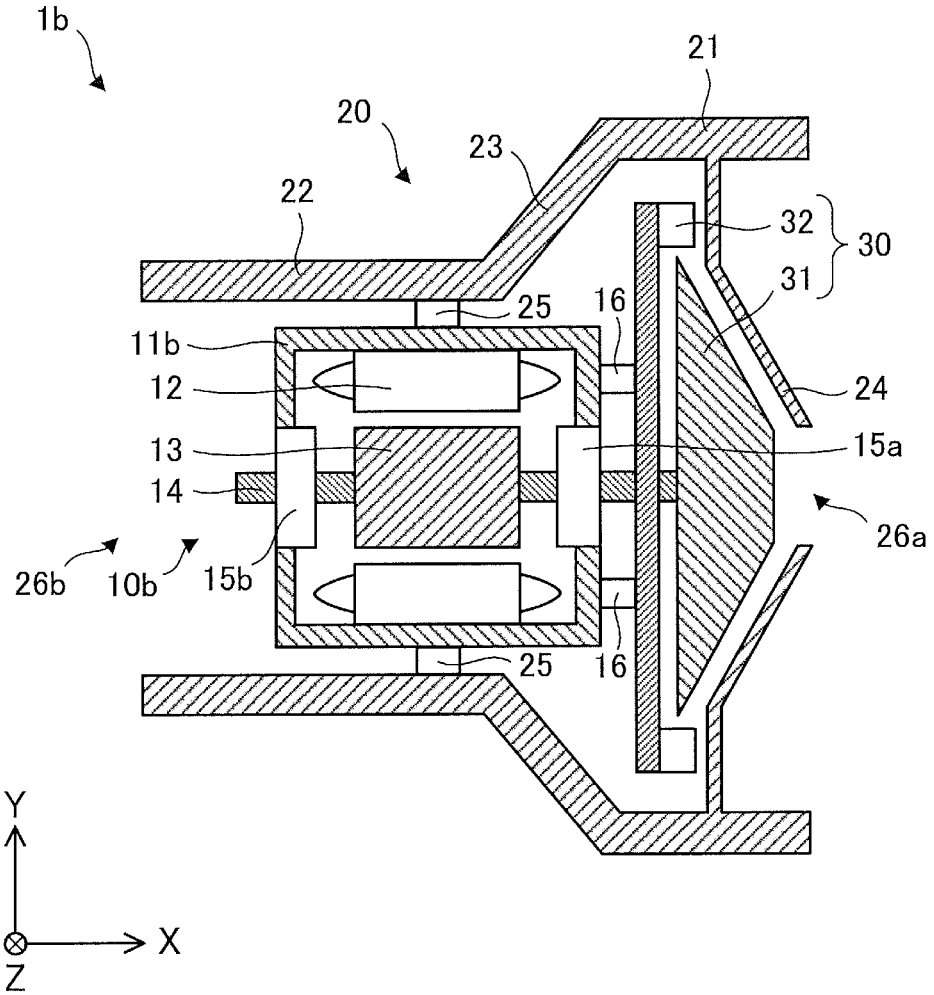
FIG. 7 is a diagram illustrating a state that the electric blower illustrated in FIG. 6 is rotated in the circumferential direction.

FIGS. 6 and 7 are sectional views schematically illustrating a structure of an electric blower 1*b* according to Modification 2 to Embodiment 1. FIG. 7 is a diagram illustrating a state that the electric blower 1*b* illustrated in FIG. 6 is rotated in the circumferential direction.

In the electric blower 1*b* according to Modification 2, a motor 10*b* (more specifically, the arrangement of bearings 15*a* and 15*b*, and the structure of a motor frame 11*b*) is different from the motor 10 of the electric blower 1 according to Embodiment 1, and these two electric blowers are the same in other respects.

The bearings 15*a* and 15*b* are fixed on both sides of the motor frame 11*b* respectively in the rotation axis direction (the X-axis direction in the example illustrated in FIGS. 6 and 7). The rotor 13 and the shaft 14 are, therefore, rotatably supported by a both-end support structure. This makes it possible to stabilize driving of the motor 10*b*.

Modification 3.

Figure 8:
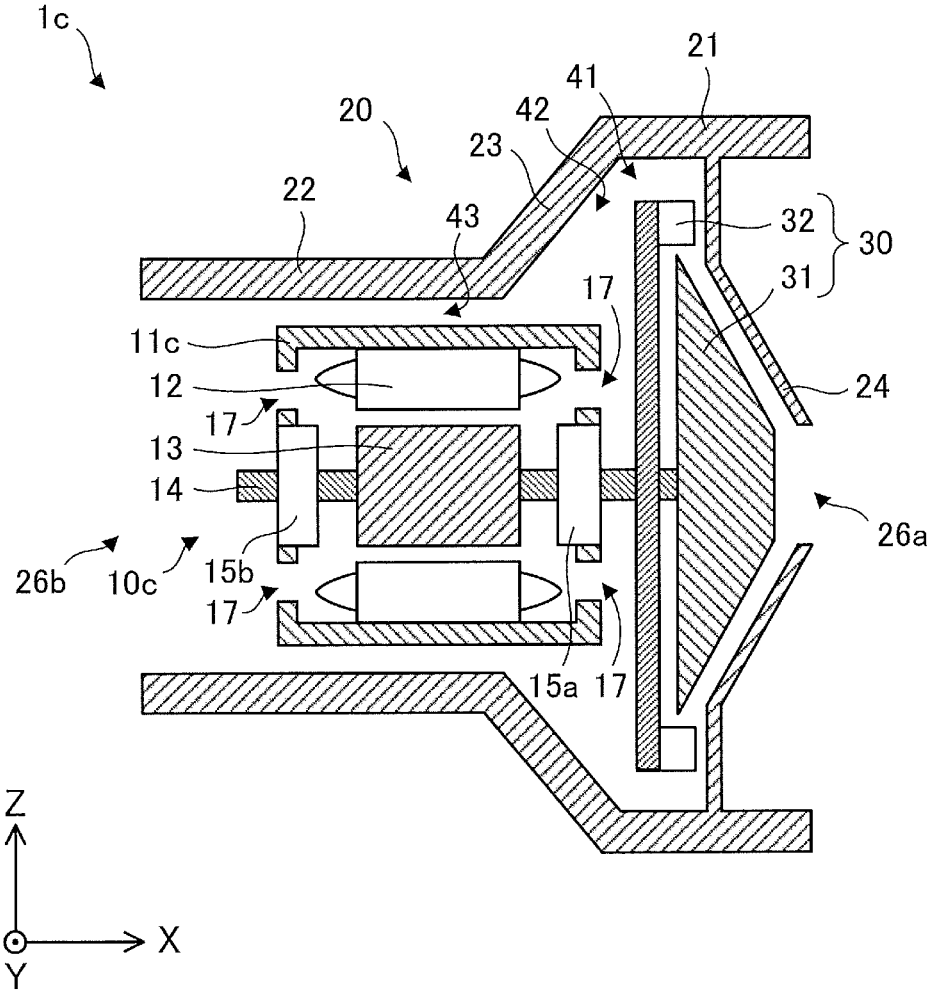
FIG. 8 is a sectional view schematically illustrating a structure of an electric blower according to Modification 3 to Embodiment 1.

FIG. 8 is a sectional view schematically illustrating a structure of an electric blower 1*c* according to Modification 3 to Embodiment 1.

In the electric blower 1*c* according to Modification 3, a motor 10*c* (more specifically, the arrangement of bearings 15*a* and 15*b*, and the structure of a motor frame 11*c*) is different from the motor 10 of the electric blower 1 according to Embodiment 1, and these two electric blowers are the same in other respects.

A plurality of through holes 17 for cooling the motor 10*c* (more specifically, the interior of the motor 10*c*) are formed at both ends of the motor frame 11*c* in the rotation axis direction (the X-axis direction in FIG. 8). During rotation of the moving blade 31, the air having passed through the second path 42 flows into the third path 43 and further flows into the interior of the motor frame 11*c* from the through hole 17 on the side of the first opening 26*a*. The air having flowed into the interior of the motor frame 11*c* passes through a through hole (air path) formed in the stator 12 and the air gap between the rotor 13 and the stator 12, and is exhausted outside the motor 10*c* from the through hole 17 on the side of the second opening 26*b*. This makes it possible to cool the motor 10*c*, and to improve the stability of the electric blower 1*c*.

The bearings 15*a* and 15*b* are fixed on both sides of the motor frame 11*c* respectively in the rotation axis direction (the X-axis direction in the example illustrated in FIG. 8). The rotor 13 and the shaft 14 are, therefore, rotatably supported by a both-end support structure. This makes it possible to stabilize driving of the motor 10*c*.

Effects of the electric blower 1 according to Embodiment 1 (including effects of the Modifications) will be described below.

Figure 9:
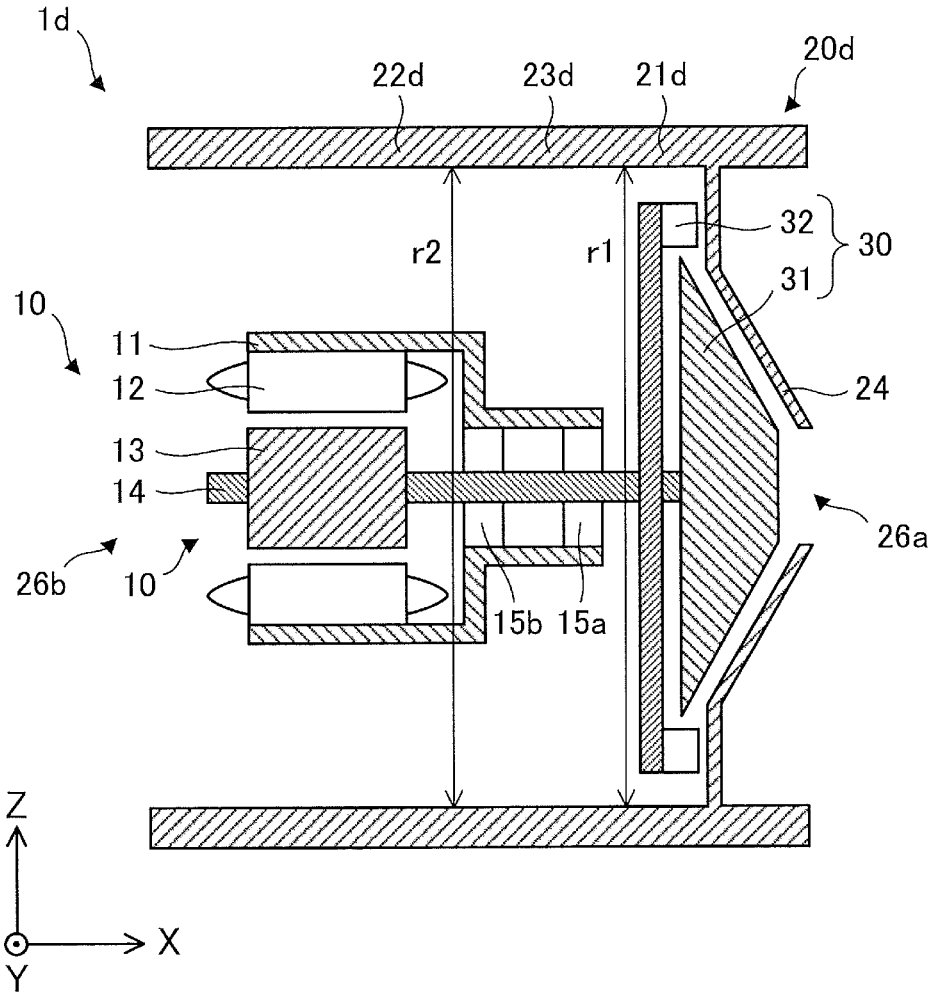
FIG. 9 is a sectional view schematically illustrating a structure of an electric blower as a Comparative Example.
Figure 10:
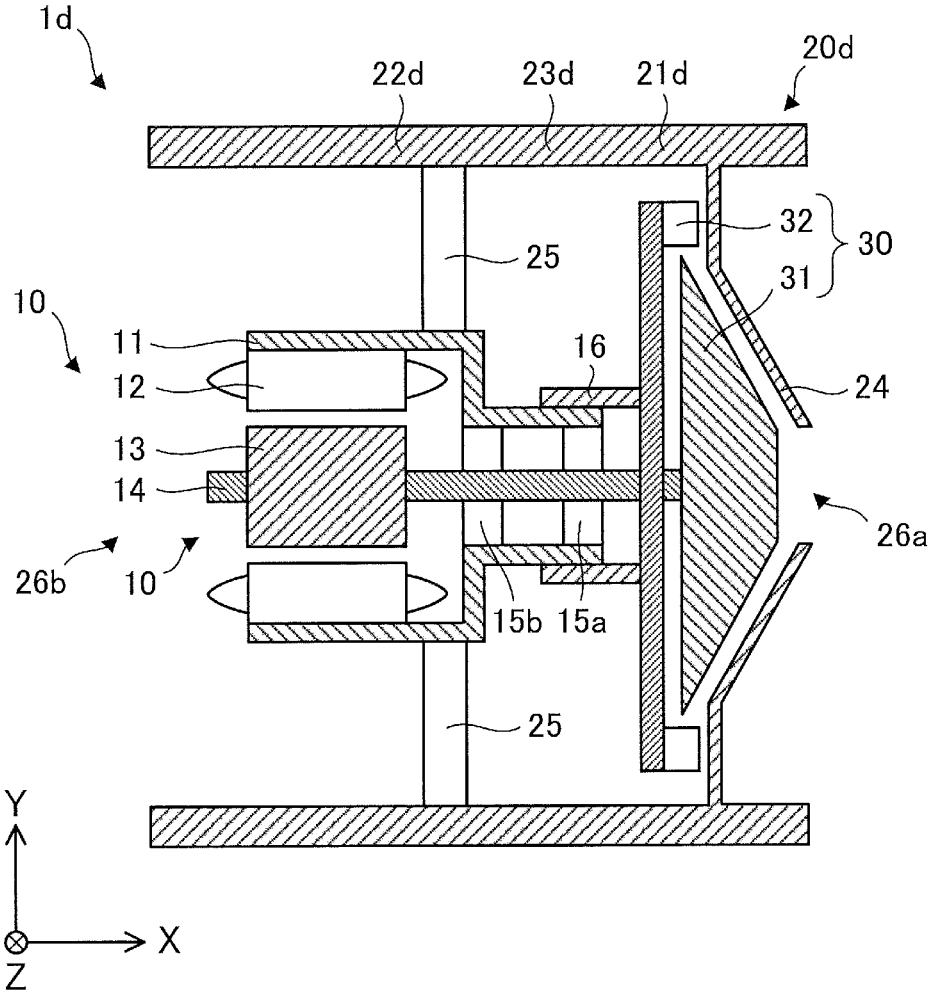
FIG. 10 is a diagram illustrating a state that the electric blower illustrated in FIG. 9 is rotated in the circumferential direction.
Figure 11:
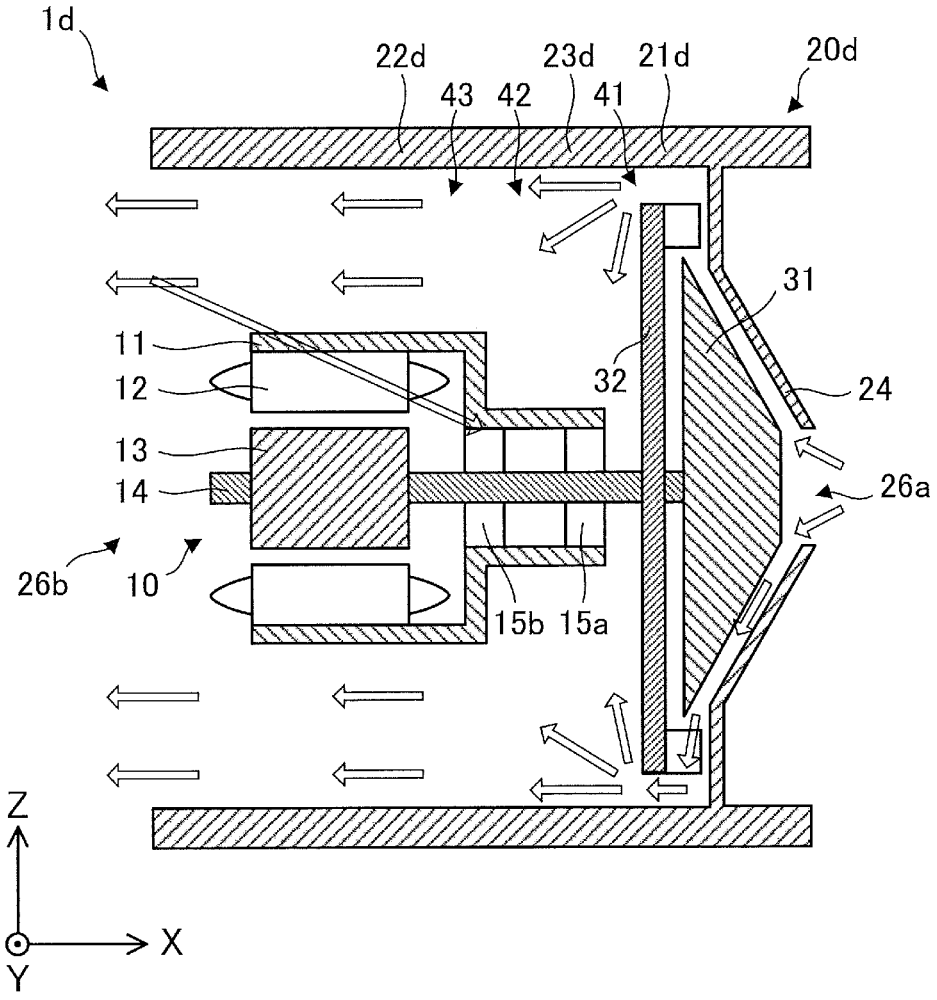
FIG. 11 is a diagram illustrating a current of air generated by rotation of a moving blade in the electric blower illustrated in FIG. 9.

FIGS. 9, 10, and 11 are sectional views schematically illustrating a structure of an electric blower 1*d* as a Comparative Example. FIG. 10 is a diagram illustrating a state that the electric blower 1*d* illustrated in FIG. 9 is rotated in the circumferential direction. FIG. 11 is a diagram illustrating a current of air generated by rotation of a moving blade 31 in the electric blower 1*d*.

Figure 12:
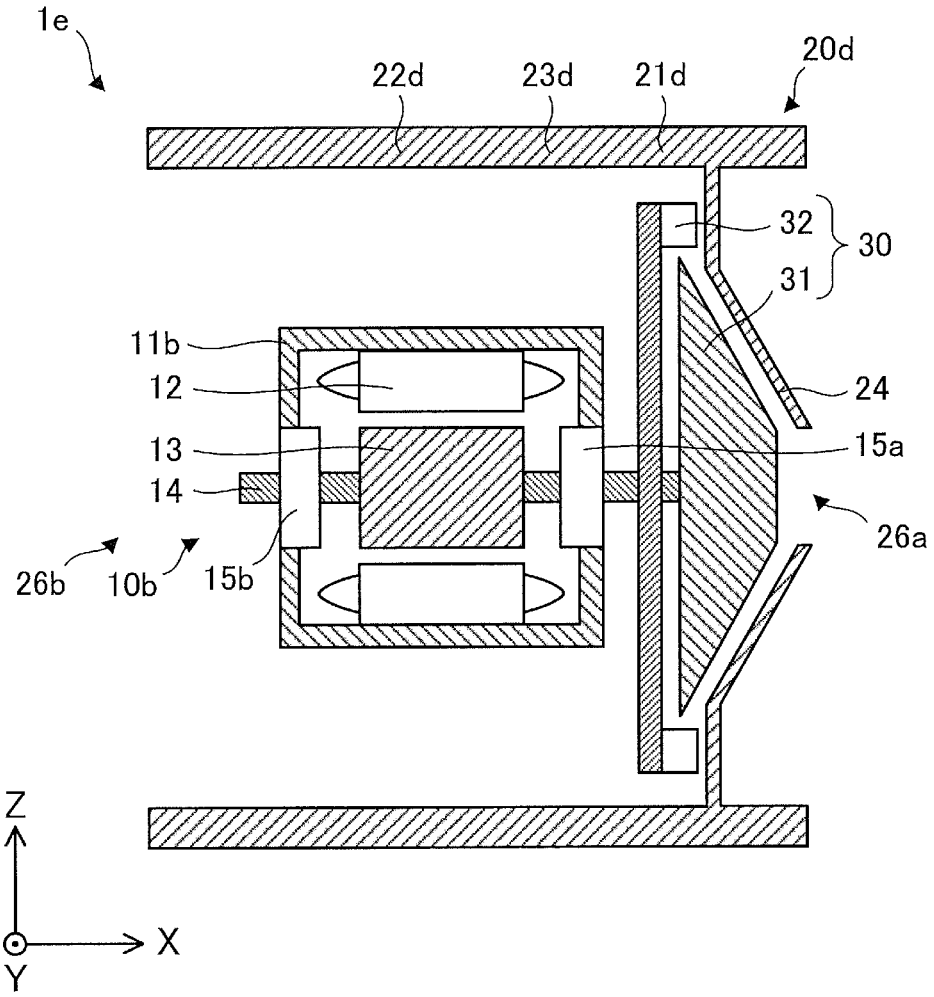
FIG. 12 is a diagram schematically illustrating a structure of an electric blower according to a Modification of the electric blower as the Comparative Example.
Figure 13:
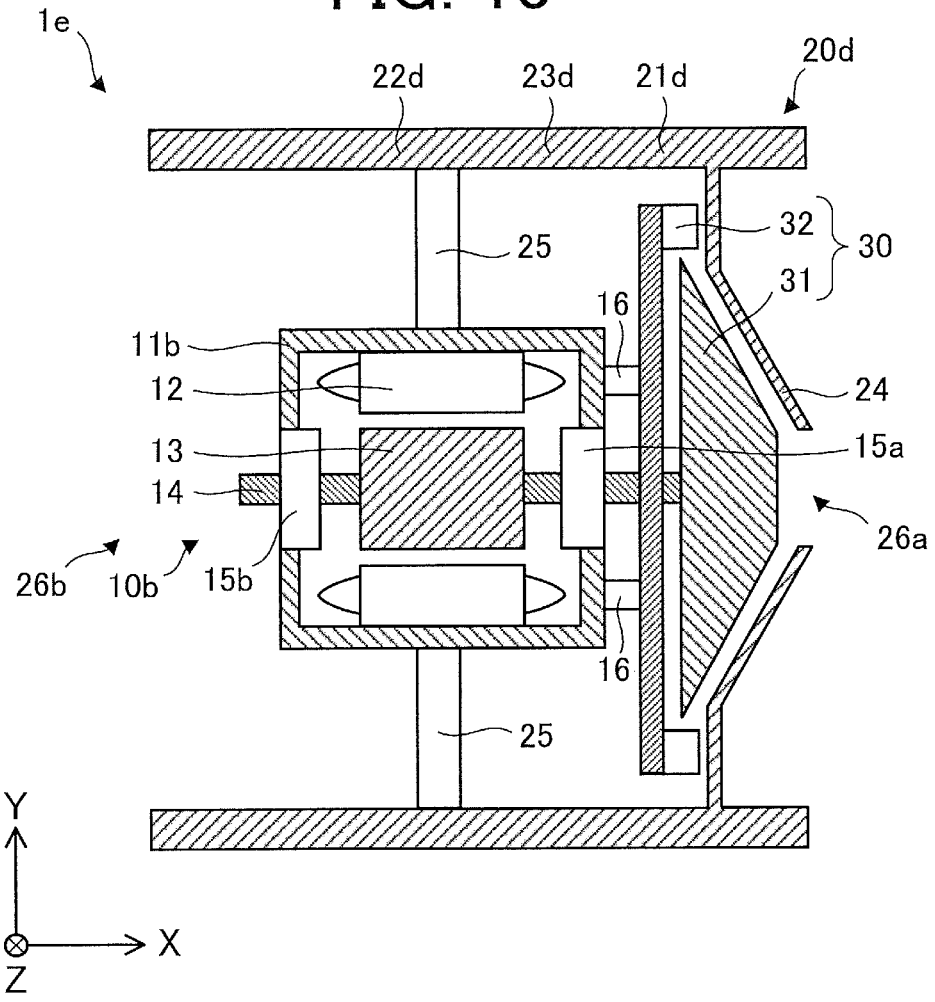
FIG. 13 is a diagram illustrating a state that the electric blower illustrated in FIG. 12 is rotated in the circumferential direction.

FIGS. 12 and 13 are diagrams schematically illustrating a structure of an electric blower 1*e* according to a Modification of the electric blower 1*d* as the Comparative Example. FIG. 13 is a diagram illustrating a state that the electric blower 1*e* illustrated in FIG. 12 is rotated in the circumferential direction. In the electric blower 1*e*, like the electric blower 1*b* illustrated in FIGS. 6 and 7, a rotor 13 and a shaft 14 are rotatably supported by a both-end support structure. The electric blower 1*e* is the same in other respects as the electric blower 1*d* illustrated in FIGS. 9 to 11.

With respect to the Comparative Example, a housing 20*d* of the electric blower 1*d* is different from the housing 20 according to Embodiment 1 (including each Modification). More specifically, the structure of a first portion 21*d*, a second portion 22*d*, and a third portion 23*d* of the housing 20*d* is different. In other words, the inner diameter r2 of the second portion 22*d* is equal to the inner diameter r1 of the first portion 21*d*. In the electric blower 1*d*, like the electric blower 1 according to Embodiment 1, the air current passes through the second path 42 and the third path 43 formed outside the motor frame 11 (between the housing 20*d* and the motor 10). There is no obstacle that blocks the air current in the second path 42 and the third path 43, the same as in the electric blower 1 according to Embodiment 1, and therefore it is possible to prevent deterioration of aerodynamic efficiency.

In the electric blower 1*d* according to the Comparative Example, since the second path 42 and the third path 43 are extended in the radial direction (for example, the Z-axis direction in FIG. 9) of the electric blower 1*d*, a pressure loss is likely to occur when the air current generated by the moving blade 31 flows from the first path 41 into the second path 42. An increase in pressure loss causes a reduction in aerodynamic efficiency of the electric blower. In addition, since the air in the third path 43 cannot come into contact with the motor frame 11 closely, heat is not sufficiently radiated from the motor 10.

With the electric blower 1 according to Embodiment 1, the widths of the second path 42 and the third path 43 are small. More specifically, the inner diameter r2 of the second portion 22 is smaller than the inner diameter r1 of the first portion 21. This regulates extension of an air path (for example, the second path 42) in the radial direction. Therefore, an increase in pressure loss when the air current generated by the moving blade 31 flows from the first path 41 into the second path 42 is kept down, and the aerodynamic efficiency is thus improved. Accordingly, the electric blower having high aerodynamic efficiency can be provided.

In addition, since the air in the third path 43 can come into contact with the motor frame 11 closely, heat can be sufficiently radiated from the motor 10. This makes it possible to prolong the life of the electric blower 1 (more specifically, the motor 10).

With the electric blower 1*a* according to Modification 1 to Embodiment 1, since at least one through hole 17 for cooling the motor 10*a* is formed in the motor frame 11*a*, the motor 10*a* can be cooled, and the heat radiation effect in the electric blower 1*a* can thus be enhanced. This makes it possible to improve the stability of the electric blower 1*a*.

With the electric blower 1*b* according to Modification 2 to Embodiment 1, the rotor 13 and the shaft 14 are rotatably supported by the both-end support structure. This makes it possible to stabilize driving of the motor 10*b*.

With the electric blower 1*c* according to Modification 3 to Embodiment 1, since the plurality of through holes 17 for cooling the motor 10*c* are formed in the motor frame 11*c*, the motor 10*c* can be cooled, and the heat radiation effect in the electric blower 1*c* can thus be enhanced. This makes it possible to improve the stability of the electric blower 1*c*. Furthermore, since the rotor 13 and the shaft 14 are rotatably supported by the both-end support structure, driving of the motor 10*c* can be stabilized.

EMBODIMENT 2

The structure and the operation of an electric blower 2 according to Embodiment 2 will be described below, mainly in terms of differences from the structure and the operation of the electric blower 1 according to Embodiment 1.

Figure 14:
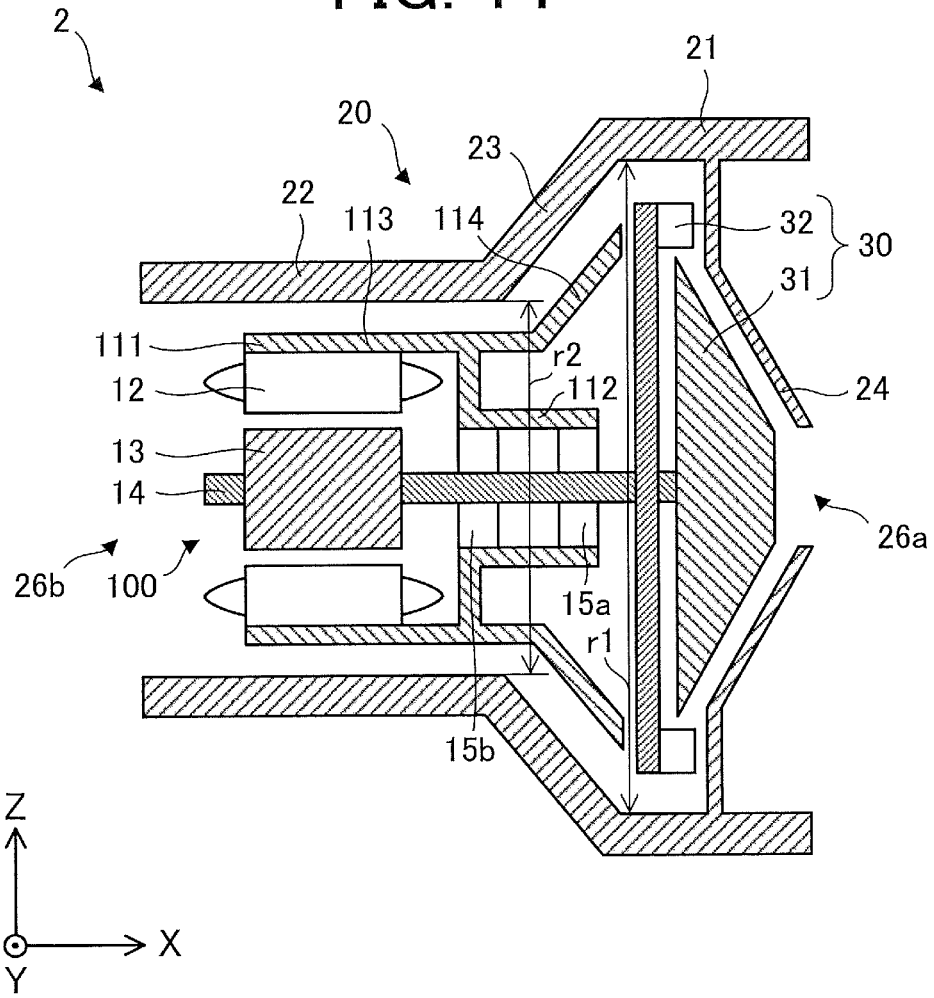
FIG. 14 is a sectional view schematically illustrating a structure of an electric blower according to Embodiment 2 of the present invention.
Figure 15:
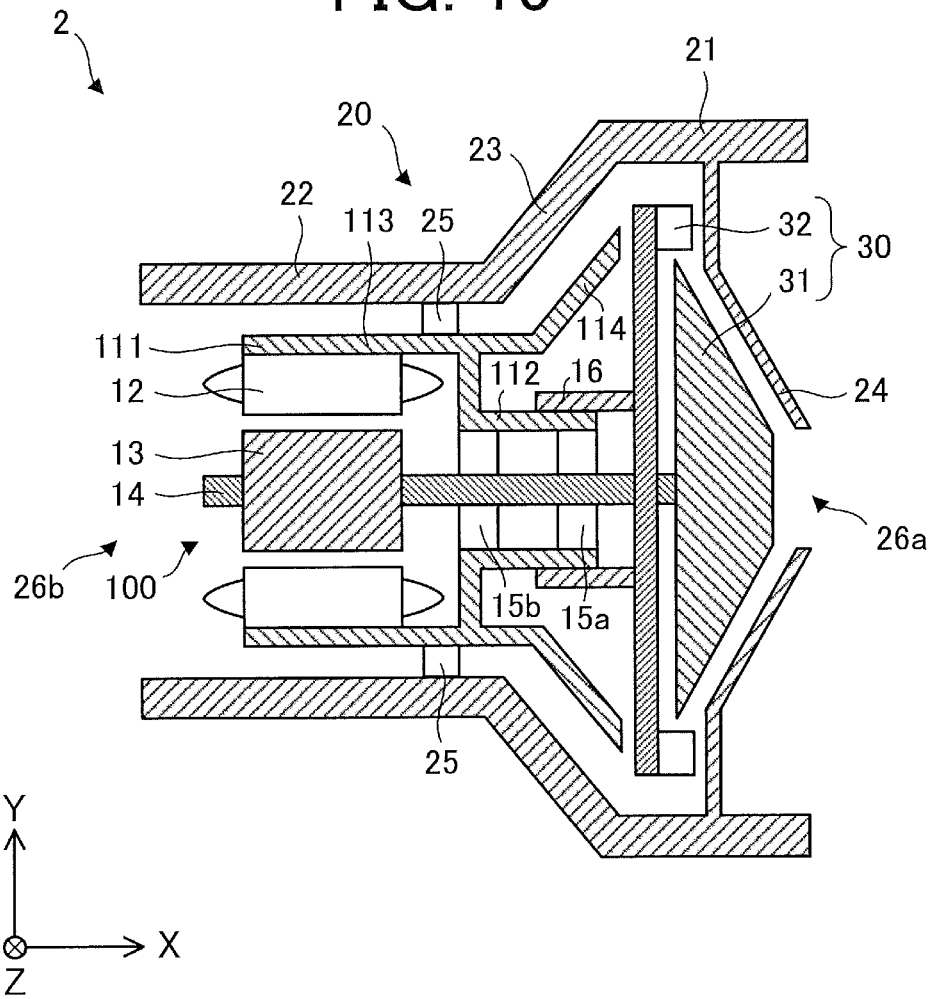
FIG. 15 is a diagram illustrating a state that the electric blower illustrated in FIG. 14 is rotated in the circumferential direction.

FIGS. 14 and 15 are sectional views schematically illustrating a structure of the electric blower 2 according to Embodiment 2 of the present invention. More specifically, FIG. 15 is a diagram illustrating a state that the electric blower 2 illustrated in FIG. 14 is rotated in the circumferential direction.

In the electric blower 2 according to Embodiment 2, a motor 100 (more specifically, the structure of a motor frame 111) is different from the motor 10 of the electric blower 1 according to Embodiment 1, and these two electric blowers are the same in other respects. In Embodiment 2, the same reference numerals as in the elements described in Embodiment 1 (including each Modification) denote the same or equivalent elements.

The electric blower 2 includes the motor 100, a housing 20, and an air blowing unit 30. The motor 100 is, for example, a permanent magnet synchronous motor. However, a motor other than the permanent magnet synchronous motor may be used as the motor 100.

The motor 100 includes the motor frame 111 (also simply called a frame), a stator 12, a rotor 13, a shaft 14, bearings 15*a* and 15*b*, and a stationary blade support portion 16.

The housing 20 includes a first portion 21, a second portion 22, a third portion 23, a fourth portion 24, a motor support portion 25, a first opening 26*a*, and a second opening 26*b* communicating with the first opening 26*a*.

The air blowing unit 30 includes a moving blade 31 and a stationary blade 32. The air blowing unit 30 generates a current of air. The moving blade 31 is, for example, a mixed-flow fan. However, the moving blade 31 is not limited to the mixed-flow fan.

The motor frame 111 includes a bearing holding portion 112 to hold the bearings 15*a* and 15*b*, a stator holding portion 113 to hold the stator 12, and a guide portion 114 (also called a projecting portion). The bearing holding portion 112, the stator holding portion 113, and the guide portion 114 are formed integrally with each other.

The guide portion 114 is provided inside the third portion 23 in the radial direction (a direction perpendicular to the axis of rotation of the moving blade 31) of the electric blower 2, and extends in a second direction D2. In other words, the guide portion 114 faces the third portion 23. In the example illustrated in FIGS. 14 and 15, the guide portion 114 projects from the stator holding portion 113 toward the air blowing unit 30.

As in the electric blower 1 according to Embodiment 1, the inner diameter r2 of the second portion 22 is smaller than the inner diameter r1 of the first portion 21.

A current of air in the electric blower 2 will be described below.

Figure 16:
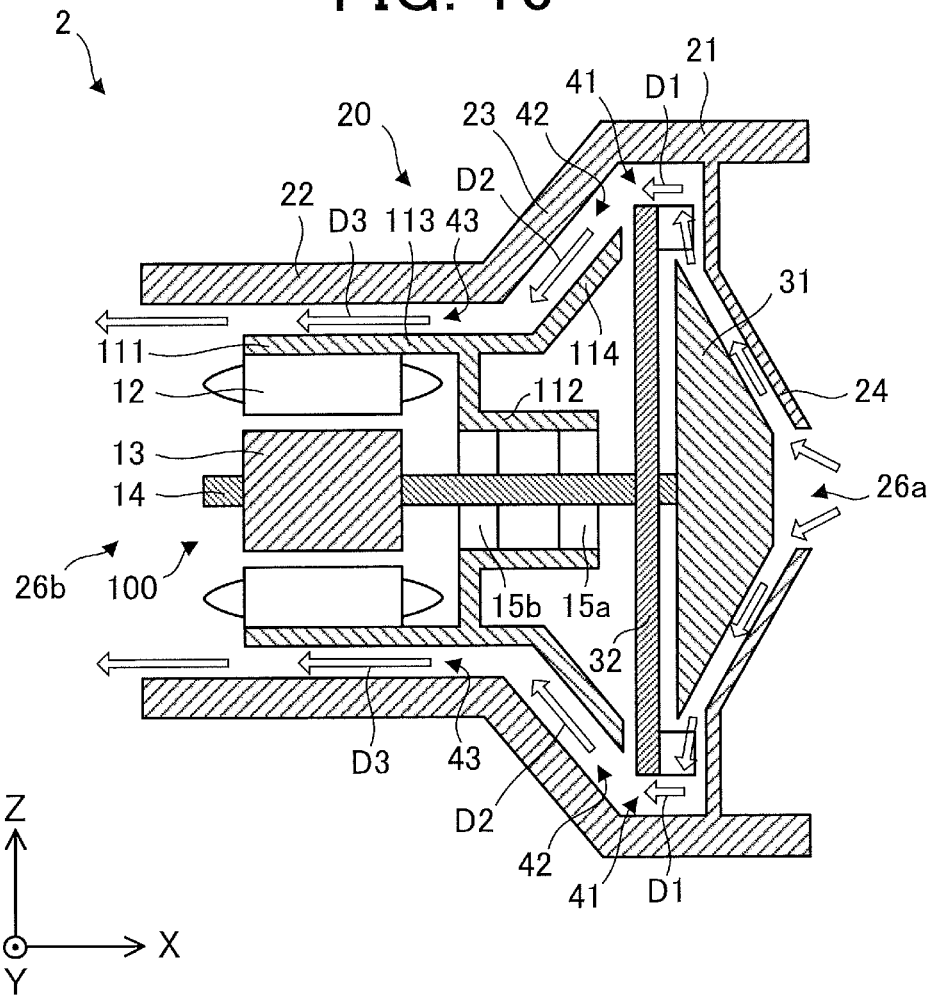
FIG. 16 is a diagram illustrating a current of air generated by rotation of a moving blade in the electric blower.

FIG. 16 is a diagram illustrating a current of air generated by rotation of the moving blade 31 in the electric blower 2.

When the motor 100 is driven, the moving blade 31 rotates, and an air current is thus generated. More specifically, air passes through the first opening 26*a* from outside the electric blower 2 and flows into the electric blower 2. The air current generated by the moving blade 31 passes through the stationary blade 32 and flows into a first path 41. In the first path 41, the air flows in a first direction D1.

The air having passed through the first path 41 flows into a second path 42. The second path 42 is formed between the third portion 23 and the guide portion 114. Therefore, the guide portion 114 guides the air having passed through the first path 41 in the second direction D2, together with the third portion 23. With this arrangement, during rotation of the moving blade 31, the air having passed through the first path 41 flows in the second direction D2 in the second path 42.

The air having passed through the second path 42 flows into a third path 43. The third path 43 is formed between the second portion 22 and the motor 100 (more specifically, the stator holding portion 113). In the third path 43, the air flows in a third direction D3.

The air having passed through the third path 43 is exhausted outside the electric blower 2 from the second opening 26*b*.

Modification 1.

Figure 17:
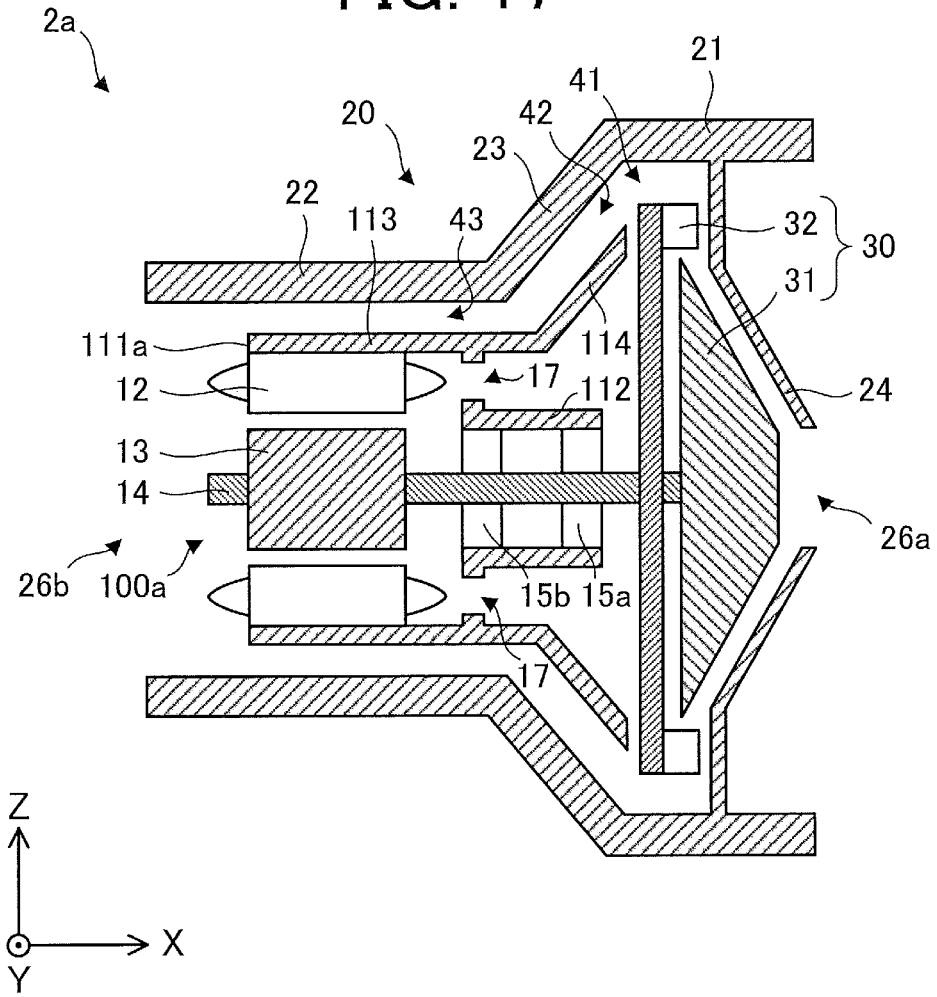
FIG. 17 is a sectional view schematically illustrating a structure of an electric blower according to Modification 1 to Embodiment 2.
Figure 18:
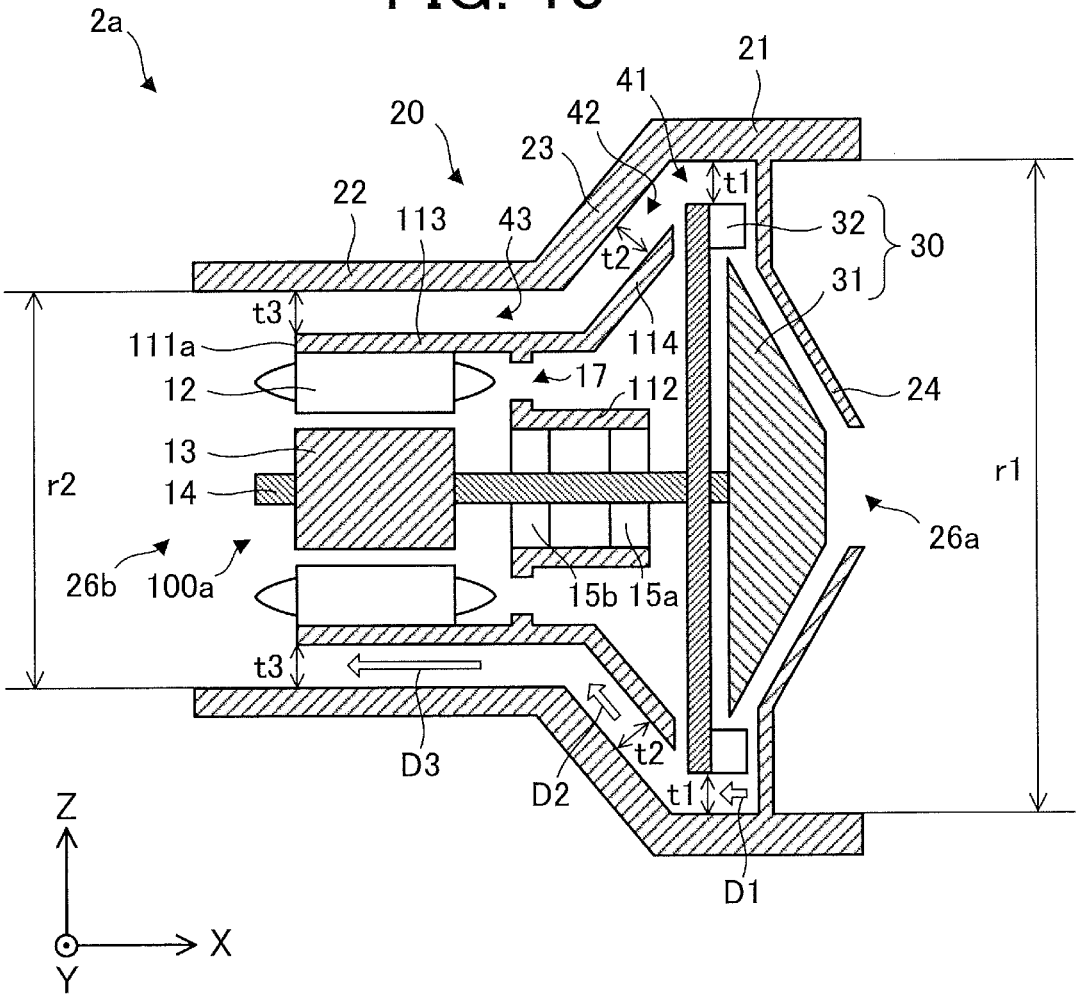
FIG. 18 is a sectional view schematically illustrating a structure of the electric blower according to Modification 1 to Embodiment 2.

FIGS. 17 and 18 are sectional views schematically illustrating a structure of an electric blower 2*a* according to Modification 1 to Embodiment 2.

The electric blower 2*a* according to Modification 1 is different from the electric blower 2 according to Embodiment 2 in that a motor frame 111*a* of a motor 100*a* includes a through hole 17, and these two electric blowers are the same in other respects.

At least one through hole 17 for cooling the motor 100*a* is formed in the motor frame 111*a*. During rotation of the moving blade 31, the air having passed through the second path 42 flows into the third path 43 and further flows into the interior of the motor frame 111*a* from the through hole 17. The air having flowed into the interior of the motor frame 111*a* passes through a through hole (air path) formed in the stator 12 and the air gap between the rotor 13 and the stator 12, and is exhausted outside the motor 100*a*. This makes it possible to cool the motor 100*a*, and to improve the stability of the electric blower 2*a*.

The width t1 of the first path 41 illustrated in FIG. 18 is in a direction perpendicular to the first direction D1 on the X-Z plane. The width t2 of the second path 42 illustrated in FIG. 18 is in a direction perpendicular to the second direction D2 on the X-Z plane. The width t3 of the third path 43 illustrated in FIG. 18 is in a direction perpendicular to the third direction D3 on the X-Z plane.

The amount of air flowing into the electric blower 2*a* is determined by the width t1 of the first path 41 and the inner diameter r1 of the first portion 21. The inner diameter r2 of the second portion 22 is smaller than the inner diameter r1 of the first portion 21. In this case, the width t2 of the second path 42 is desirably larger than the width t1 of the first path 41. In addition, the width t3 of the third path 43 (in particular, the width of the exit of the third path 43) is desirably larger than the width t1 of the first path 41 and the width t2 of the second path 42. This makes it possible to keep down an increase in air pressure.

Modification 2.

Figure 19:
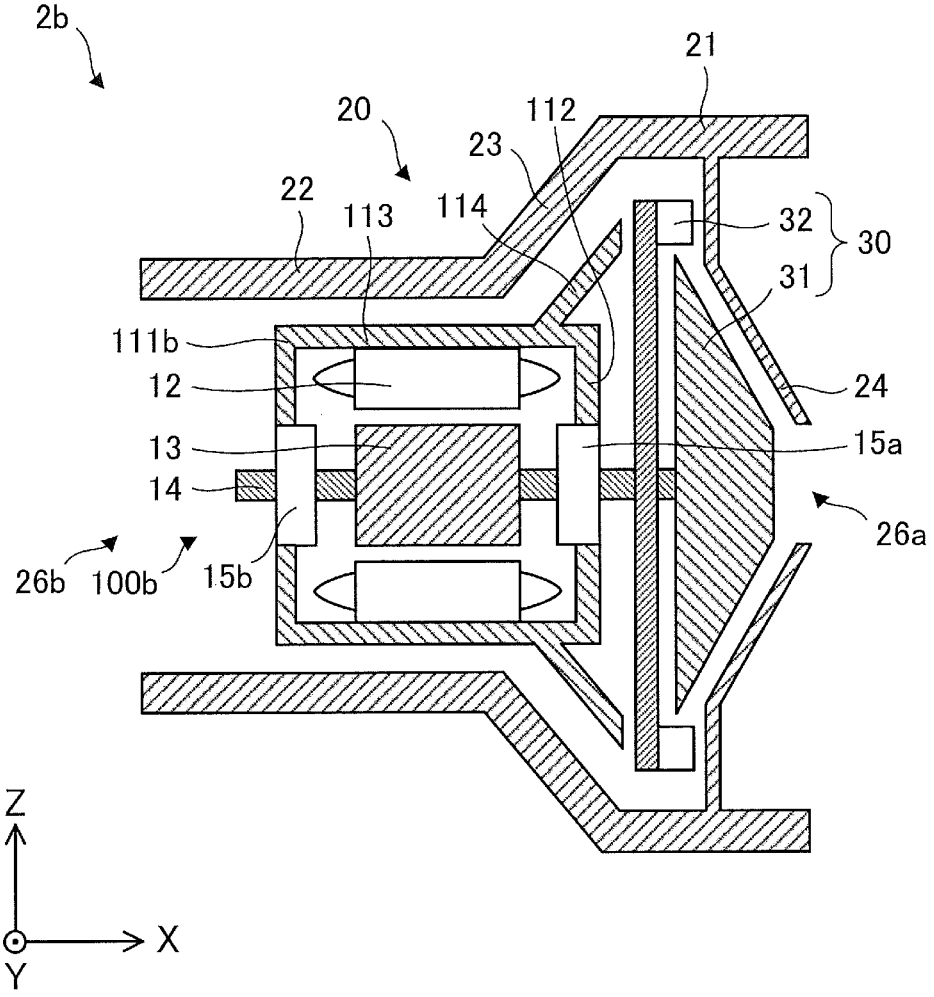
FIG. 19 is a sectional view schematically illustrating a structure of an electric blower according to Modification 2 to Embodiment 2.
Figure 20:
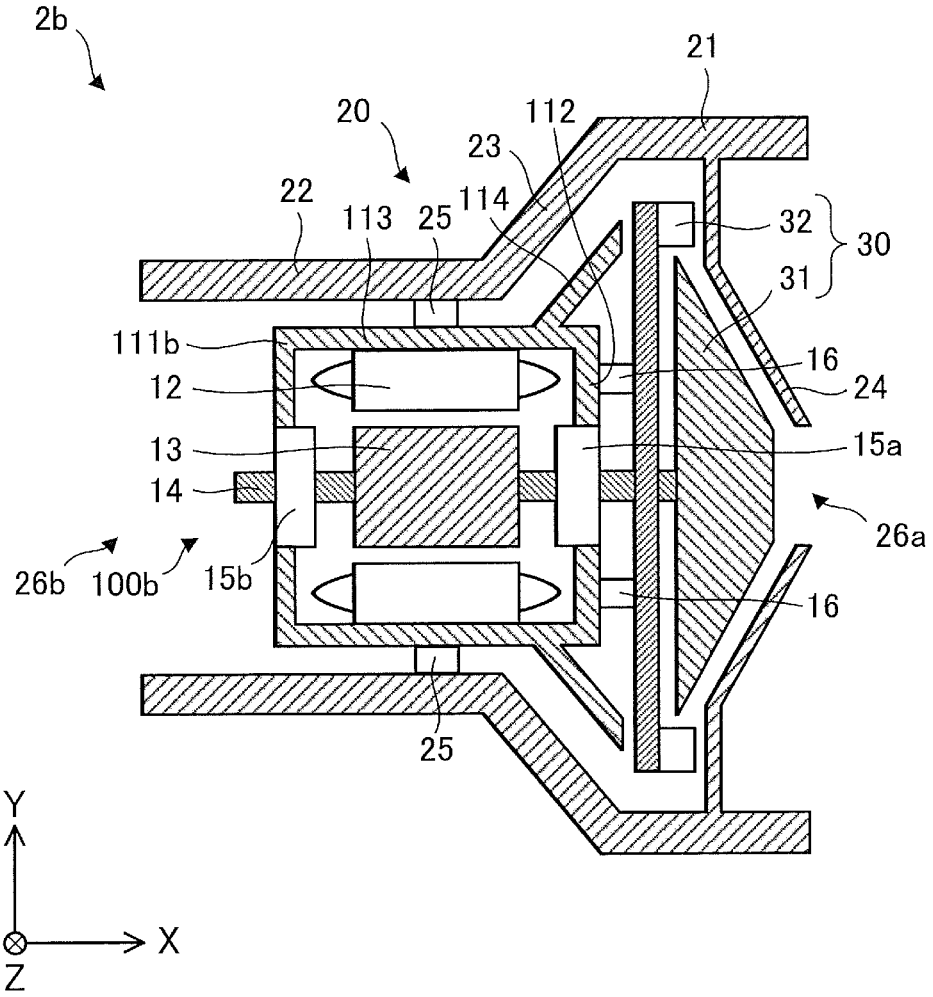
FIG. 20 is a diagram illustrating a state that the electric blower illustrated in FIG. 19 is rotated in the circumferential direction.

FIGS. 19 and 20 are sectional views schematically illustrating a structure of an electric blower 2*b* according to Modification 2 to Embodiment 2. FIG. 20 is a diagram illustrating a state that the electric blower 2*b* illustrated in FIG. 19 is rotated in the circumferential direction.

In the electric blower 2*b* according to Modification 2, a motor 100*b* (more specifically, the arrangement of bearings 15*a* and 15*b*, and the structure of a motor frame 111*b*) is different from the motor 100 of the electric blower 2 according to Embodiment 2, and these two electric blowers are the same in other respects.

The bearings 15*a* and 15*b* are fixed on both sides of the motor frame 111*b* respectively in the rotation axis direction (the X-axis direction in the example illustrated in FIGS. 18 and 19). The rotor 13 and the shaft 14 are, therefore, rotatably supported by a both-end support structure. This makes it possible to stabilize driving of the motor 100*b*.

Modification 3.

Figure 21:
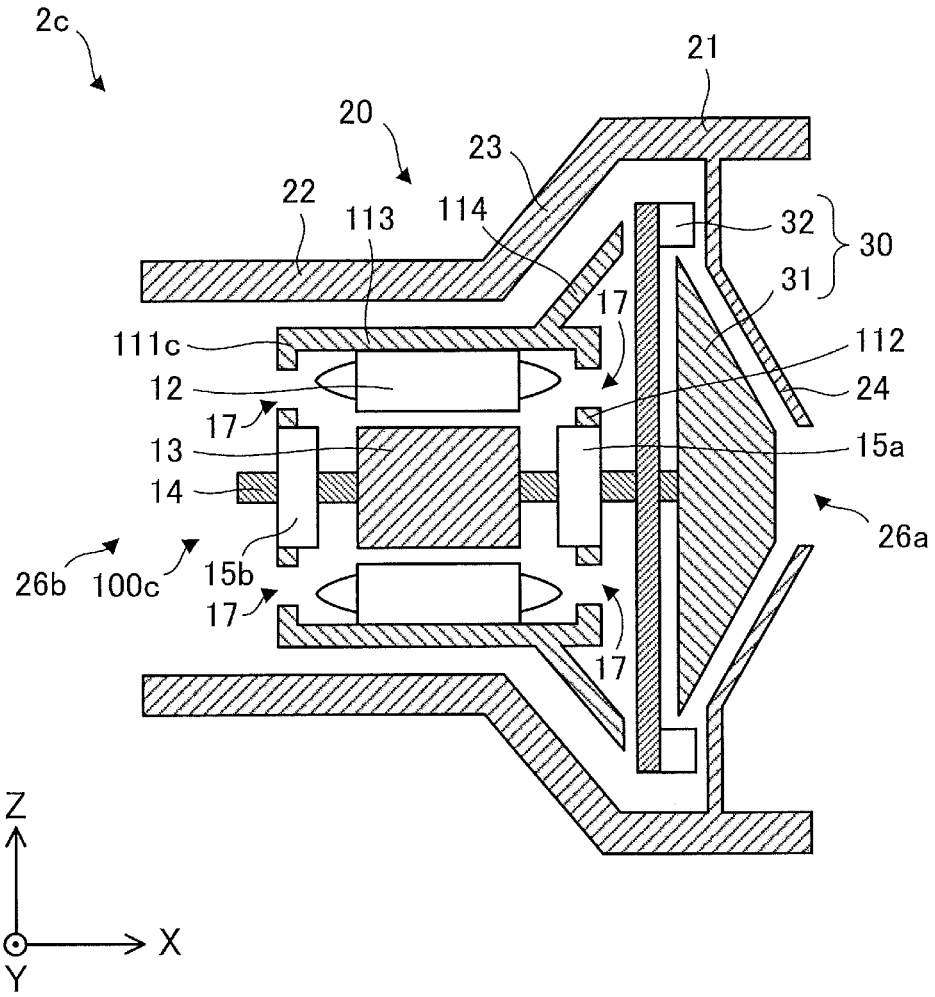
FIG. 21 is a sectional view schematically illustrating a structure of an electric blower according to Modification 3 to Embodiment 2.

FIG. 21 is a sectional view schematically illustrating a structure of an electric blower 2*c* according to Modification 3 to Embodiment 2.

In the electric blower 2*c* according to Modification 3, a motor 100*c* (more specifically, the arrangement of bearings 15*a* and 15*b*, and the structure of a motor frame 111*c*) is different from the motor 100 of the electric blower 2 according to Embodiment 2, and these two electric blowers are the same in other respects.

A plurality of through holes 17 for cooling the motor 100*c* are formed in the motor frame 111*c*. During rotation of the moving blade 31, the air having passed through the second path 42 flows into the third path 43 and further flows into the interior of the motor frame 111*c* from the through hole 17 on the side of the first opening 26*a*. The air having flowed into the interior of the motor frame 111*c* passes through a through hole (air path) formed in the stator 12 and the air gap between the rotor 13 and the stator 12, and is exhausted outside the motor 100*c* from the through hole 17 on the side of the second opening 26*b*. This makes it possible to cool the motor 100*c*, and to improve the stability of the electric blower 2*c*.

The bearings 15*a* and 15*b* are fixed on both sides of the motor frame 111*c* respectively in the rotation axis direction (the X-axis direction in the example illustrated in FIG. 21). The rotor 13 and the shaft 14 are, therefore, rotatably supported by a both-end support structure. This makes it possible to stabilize driving of the motor 100*c*.

The effect of the electric blower 2 according to Embodiment 2 (including effects of Modifications) will be described below.

The electric blower 2 according to Embodiment 2 has the same effect as in the electric blower 1 according to Embodiment 1. The electric blower 2 further has the following effect.

In the electric blower 2 according to Embodiment 2, the inner diameter r2 of the second portion 22 is smaller than the inner diameter r1 of the first portion 21. In addition, the electric blower 2 includes a guide portion 114 facing the third portion 23. This regulates extension of an air path (for example, the second path 42) in the radial direction. Therefore, an increase in pressure loss when the air current generated by the moving blade 31 flows from the first path 41 into the second path 42 is further kept down, and the aerodynamic efficiency is thus further improved.

With the electric blower 2*a* according to Modification 1 to Embodiment 2, since at least one through hole 17 for cooling the motor 100*a* (more specifically, the interior of the motor 100*a*) is formed in the motor frame 111*a*, the motor 100*a* can be cooled, and the heat radiation effect in the electric blower 2*a* can thus be enhanced. This makes it possible to improve the stability of the electric blower 2*a*.

With the electric blower 2*b* according to Modification 2 to Embodiment 2, the rotor 13 and the shaft 14 are rotatably supported by a both-end support structure. This makes it possible to stabilize driving of the motor 100*b*.

With the electric blower 2*c* according to Modification 3 to Embodiment 2, since a plurality of through holes 17 for cooling the motor 100*c* (more specifically, the interior of the motor 100*c*) are formed in the motor frame 111*c*, the motor 100*c* can be cooled, and the heat radiation effect in the electric blower 2*c* can thus be enhanced. This makes it possible to improve the stability of the electric blower 2*c*. Furthermore, since the rotor 13 and the shaft 14 are rotatably supported by a both-end support structure, driving of the motor 100*c* can be stabilized.

EMBODIMENT 3

The structure and the operation of an electric blower 3 according to Embodiment 3 will be described below, mainly in terms of differences from the structure and the operation of the electric blower 1 according to Embodiment 1.

Figure 22:
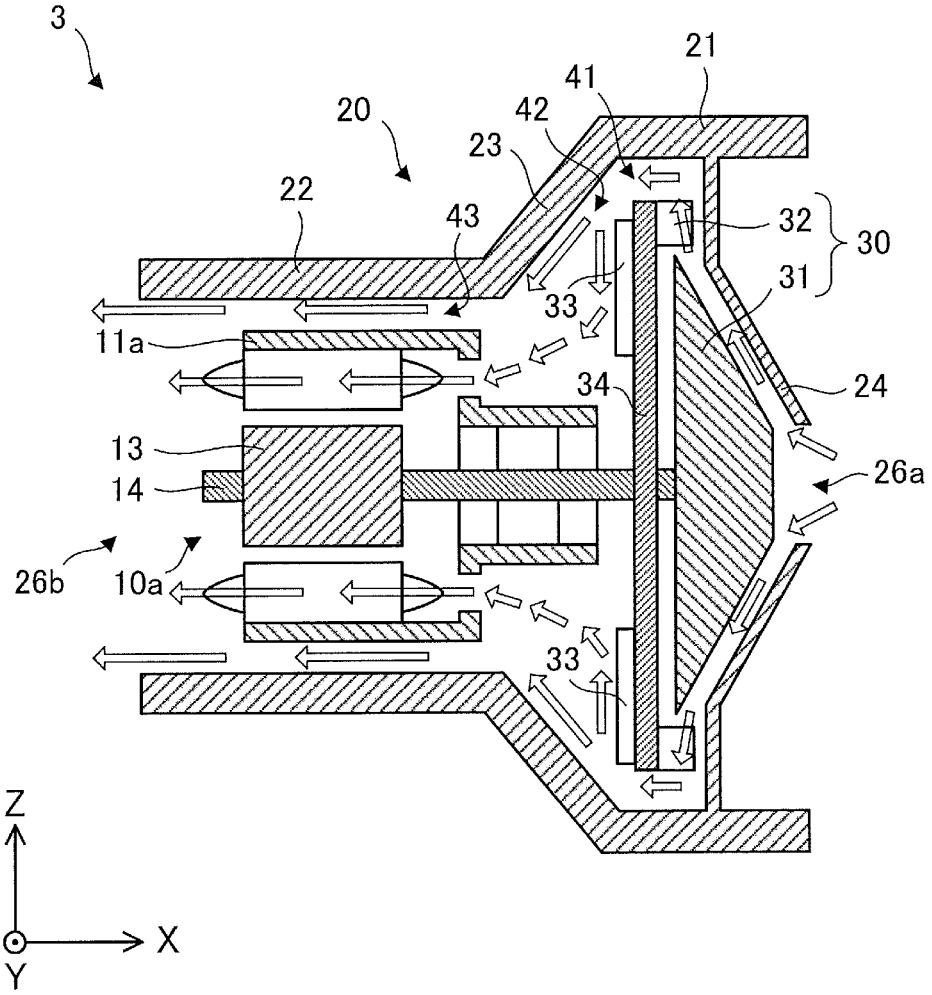
FIG. 22 is a sectional view schematically illustrating a structure of an electric blower according to Embodiment 3.

FIG. 22 is a sectional view schematically illustrating a structure of the electric blower 3 according to Embodiment 3.

Figure 23A:
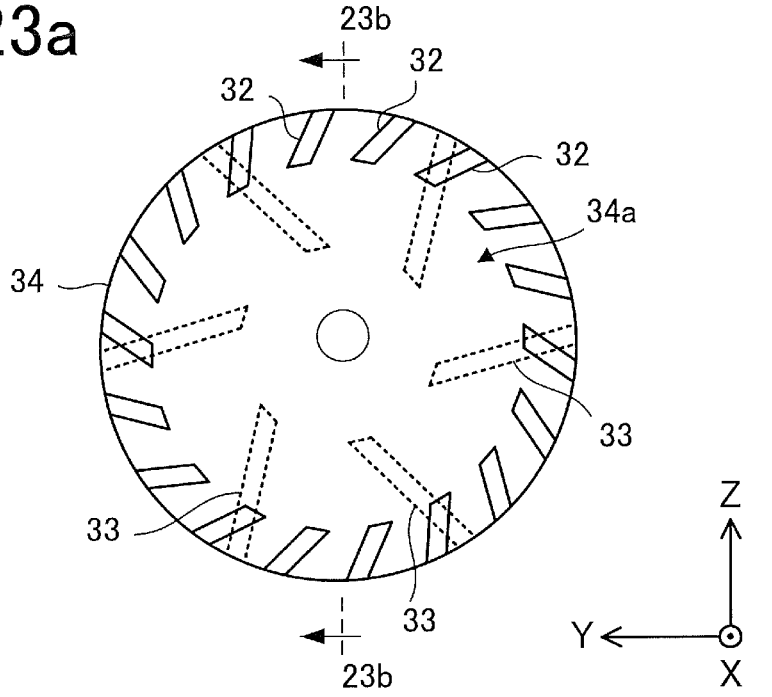
FIG. 23*a* is a plan view illustrating a structure around stationary blades.
Figure 23B:
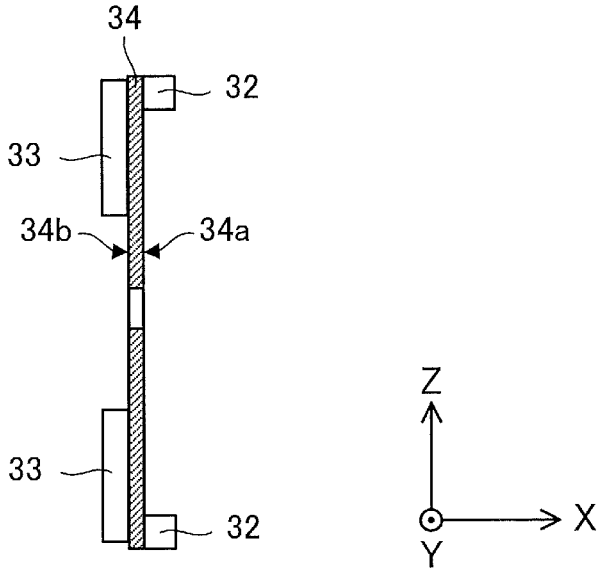
FIG. 23*b* is a sectional view taken along a line 23*b*-23*b* in FIG. 23*a*.

FIG. 23*a* is a plan view illustrating a structure around the stationary blades 32, and FIG. 23*b* is a sectional view taken along a line 23*b*-23*b* in FIG. 23*a*.

The electric blower 3 according to Embodiment 3 includes at least one baffle plate 33. The electric blower 3 is the same in other respects as in Embodiment 1 (more specifically, Modification 1 to Embodiment 1). In Embodiment 3, reference numerals assigned to elements that are the same as or correspond to the elements described in Embodiment 1 (including each Modification) are the same as the reference numerals assigned to the elements described in Embodiment 1.

In the electric blower 3, at least one baffle plate 33 is provided between the stationary blade 32 and the motor 10*a*. The baffle plate 33 guides an air current generated by rotation of the moving blade 31 toward the motor 10*a*. A main plate 34 has a first surface 34*a* on the front side, and a second surface 34*b* on the back side. A plurality of stationary blades 32 are formed on the first surface 34*a*, and a plurality of baffle plates 33 are formed on the second surface 34*b*. The plurality of stationary blades 32 and the plurality of baffle plates 33 are spirally arranged to have opposite phases.

As illustrated in FIG. 22, a part of the air current having passed through the first path 41 is guided inside in the radial direction by the baffle plate 33. This allows the part of the air current having passed through the first path 41 to readily flow into the motor frame 11*a*.

Modification.

Figure 24:
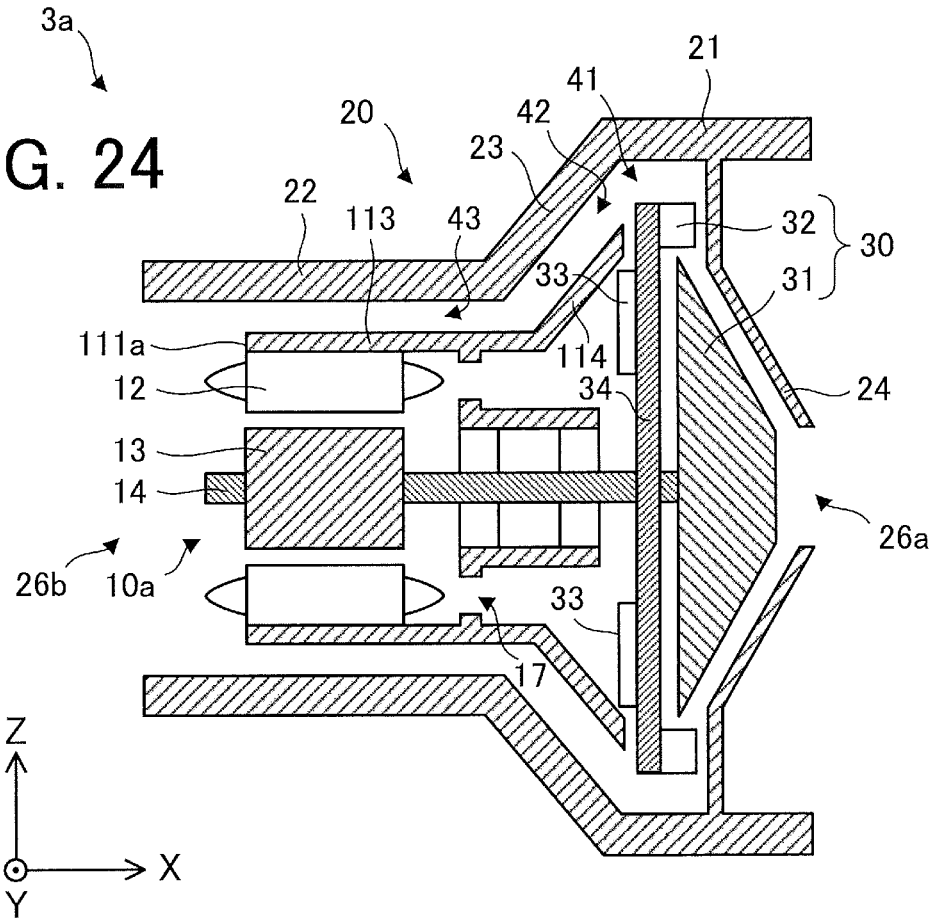
FIG. 24 is a sectional view schematically illustrating a structure of an electric blower according to a Modification to Embodiment 3.

FIG. 24 is a sectional view schematically illustrating a structure of an electric blower 3*a* according to a Modification to Embodiment 3.

The electric blower 3*a* according to the Modification is different in the structure of a motor frame 111*a* from the electric blower 3 according to Embodiment 3, and these two electric blowers are the same in other respects. The structure and the function of the motor frame 111*a* are the same as those in Modification 1 to Embodiment 2.

The electric blower 3*a* according to the Modification includes a guide portion 114 facing the third portion 23. This regulates extension of an air path (for example, the second path 42) in the radial direction. Therefore, compared to the electric blower 3 according to Embodiment 3, an increase in pressure loss when the air current generated by the moving blade 31 flows from the first path 41 into the second path 42 is further kept down, and the aerodynamic efficiency is thus improved more.

The effect of the electric blower 3 according to Embodiment 3 (including the effect of the Modification) will be described below.

The electric blower 3 according to Embodiment 3 has the same effect as in the electric blower 1 according to Embodiment 1. The electric blower 3 further has the following effect.

The electric blower 3 according to Embodiment 3 allows a part of the air current having passed through the first path 41 to readily flow into the motor frame 11*a*. This makes it possible to enhance the heat radiation effect in the motor 10*a*.

With the electric blower 3*a* according to the Modification to Embodiment 3, since an increase in pressure loss when the air current generated by the moving blade 31 flows from the first path 41 into the second path 42 is further kept down, the aerodynamic efficiency can further be improved.

EMBODIMENT 4

Figure 25:
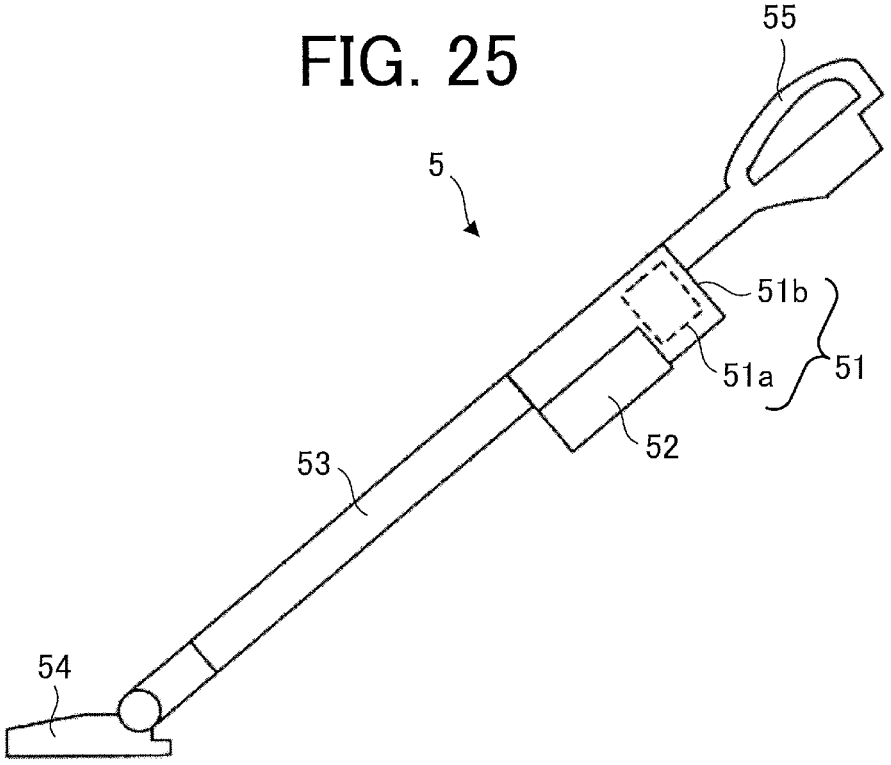
FIG. 25 is a side view schematically illustrating a vacuum cleaner according to Embodiment 4.

FIG. 25 is a side view schematically illustrating a vacuum cleaner 5 according to Embodiment 4.

The vacuum cleaner 5 includes a main body 51, a dust chamber 52 to collect dust, a duct 53, a suction nozzle 54, and a gripping portion 55.

The main body 51 includes an electric blower 51*a* to produce suction force (suction air), and an exhaust port 51*b*. The electric blower 51*a* is identical to the electric blower 1 according to Embodiment 1 (including each Modification), the electric blower 2 according to Embodiment 2 (including each Modification), or the electric blower 3 according to Embodiment 3 (including each Modification).

The dust chamber 52 is mounted on the main body 51. However, the dust chamber 52 may be provided inside the main body 51. The dust chamber 52 is, for example, a container including a filter to separate dust and air. The suction nozzle 54 is mounted at the distal end of the duct 53.

When the vacuum cleaner 5 is turned on, power is supplied to the electric blower 51*a* and the electric blower 51*a* can thus be driven. During driving of the electric blower 51*a*, dust is sucked up from the suction nozzle 54 by the suction force produced by the electric blower 51*a*. The dust sucked up from the suction nozzle 54 passes through the duct 53 and then is collected in the dust chamber 52. The air sucked up from the suction nozzle 54 passes through the electric blower 51*a* and then is exhausted outside the vacuum cleaner 5 from the exhaust port 51*b*.

The vacuum cleaner 5 according to Embodiment 4 includes the electric blower described in any of Embodiments 1 to 3, and therefore has the same effect as that described in any of Embodiments 1 to 3.

In addition, with the vacuum cleaner 5 according to Embodiment 4, since an increase in pressure loss in the electric blower 51*a* is kept down and the aerodynamic efficiency is thus improved, the vacuum cleaner having high suction power can be provided.

EMBODIMENT 5

Figure 26:
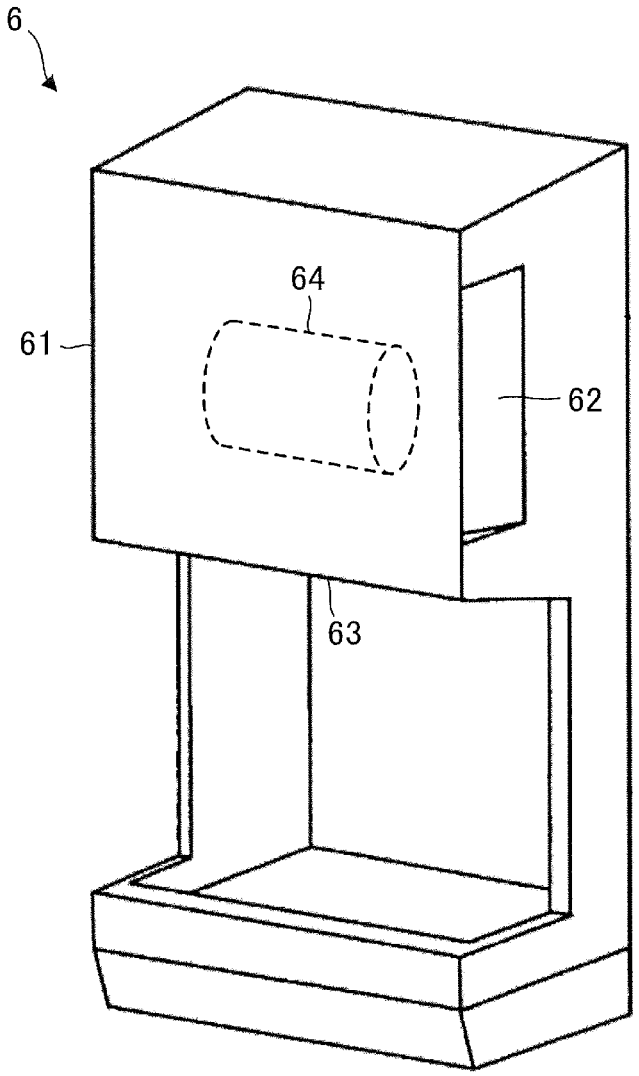
FIG. 26 is a perspective view schematically illustrating a hand dryer as a hand drying device according to Embodiment 5.

FIG. 26 is a perspective view schematically illustrating a hand dryer 6 as a hand drying device according to Embodiment 5.

The hand dryer 6 serving as a hand drying device includes a housing 61 (also called a casing) and an electric blower 64. The housing 61 includes an air inlet 62 and an air outlet 63. The electric blower 64 is fixed in the housing 61.

The electric blower 64 is the electric blower 1 according to Embodiment 1 (including each Modification), the electric blower 2 according to Embodiment 2 (including each Modification), or the electric blower 3 according to Embodiment 3 (including each Modification). The electric blower 64 performs air suction and blowing air by generating an air current. More specifically, the electric blower 64 sucks up air exterior to the housing 61 through the air inlet 62 and sends the air outside the housing 61 through the air outlet 63.

When the hand dryer 6 is turned on, power is supplied to the electric blower 64 and the electric blower 64 can thus be driven. During driving of the electric blower 64, air exterior to the hand dryer 6 is sucked up from the air inlet 62. The air sucked up from the air inlet 62 passes through the inside of the electric blower 64 and then is exhausted from the air outlet 63. When a user of the hand dryer 6 puts his or her hand near the air outlet 63, droplets of water on the hand can be blow away and the hand can be dried.

The hand dryer 6 according to Embodiment 5 includes the electric blower described in any of Embodiments 1 to 3, and therefore has the same effect as that described in any of Embodiments 1 to 3.

In addition, with the hand dryer 6 according to Embodiment 5, since an increase in pressure loss in the electric blower 64 is kept down and the aerodynamic efficiency is thus improved, the hand dryer having highly efficient can be provided.

The features in the Embodiments and the features in the Modifications described above can be combined with each other as appropriate.

What is claimed is:

1. An electric blower comprising:

an air blowing unit including a mixed-flow fan to generate a current of air;

a permanent magnet synchronous motor to rotate the mixed-flow fan;

a housing including a first opening, a second opening communicating with the first opening, a first portion surrounding the mixed-flow fan in a circumferential direction, a second portion surrounding the permanent magnet synchronous motor in the circumferential direction, and a third portion provided between the first portion and the second portion;

a first path formed between the first portion and the air blowing unit and to allow the air to flow in a first direction; and a second path formed between the third portion and the guide portion and to allow the air to flow in the second direction, wherein the permanent magnet synchronous motor includes a guide portion provided inside the third portion in a radial direction and to guide the air in a second direction, and an inner diameter of the second portion is smaller than an inner diameter of the first portion, wherein a width of the second path in a direction perpendicular to the second direction is larger than a width of the first path in a direction perpendicular to the first direction.

2. The electric blower according to claim 1, wherein the third portion is formed integrally with the first portion and the second portion.

3. The electric blower according to claim 1, further comprising a third path formed between the second portion and the permanent magnet synchronous motor and to allow the air to flow in a third direction.

4. The electric blower according to claim 1, wherein the permanent magnet synchronous motor includes:

a motor frame;

a stator fixed inside the motor frame; and a rotor inserted inside the stator, and wherein the motor frame includes a through hole through which the air passes.

5. The electric blower according to claim 1, wherein during rotation of the mixed-flow fan, the air flows toward the second opening.

6. The electric blower according to claim 1, wherein the air blowing unit includes a stationary blade.

7. The electric blower according to claim 6, further comprising a baffle plate provided between the stationary blade and the permanent magnet synchronous motor and to guide an air current generated by rotation of the mixed-flow fan toward the permanent magnet synchronous motor.

8. A vacuum cleaner comprising:

the electric blower according to claim 1 to produce suction force; and a dust chamber in which dust sucked up by the suction force is collected.

9. A hand drying device comprising:

a casing including an air inlet and an air outlet; and the electric blower according to claim 1 fixed in the casing, and to suck up air exterior to the casing through the air inlet and send the air outside the casing through the air outlet.

10. An electric blower comprising:

an air blowing unit including a mixed-flow fan to generate a current of air;

a permanent magnet synchronous motor to rotate the mixed-flow fan;

a housing including a first opening, a second opening communicating with the first opening, a first portion surrounding the mixed-flow fan in a circumferential direction, a second portion surrounding the permanent magnet synchronous motor in the circumferential direction, and a third portion provided between the first portion and the second portion;

a first path formed between the first portion and the air blowing unit and to allow the air to flow in a first direction;

a second path formed between the third portion and the guide portion and to allow the air to flow in the second direction; and a third path formed between the second portion and the permanent magnet synchronous motor and to allow the air to flow in a third direction, wherein the permanent magnet synchronous motor includes a guide portion provided inside the third portion in a radial direction and to guide the air in a second direction, and an inner diameter of the second portion is smaller than an inner diameter of the first portion, wherein a width of the third path in a direction perpendicular to the third direction is larger than a width of the first path in a direction perpendicular to the first direction.

11. The electric blower according to claim 10, wherein the third portion is formed integrally with the first portion and the second portion.

12. The electric blower according to claim 10, wherein the permanent magnet synchronous motor includes:

a motor frame;

a stator fixed inside the motor frame; and a rotor inserted inside the stator, and wherein the motor frame includes a through hole through which the air passes.

13. A vacuum cleaner comprising:

the electric blower according to claim 10 to produce suction force; and a dust chamber in which dust sucked up by the suction force is collected.

14. A hand drying device comprising:

a casing including an air inlet and an air outlet; and the electric blower according to claim 10 fixed in the casing, and to suck up air exterior to the casing through the air inlet and send the air outside the casing through the air outlet.

15. An electric blower comprising:

an air blowing unit including a mixed-flow fan to generate a current of air;

a permanent magnet synchronous motor to rotate the mixed-flow fan;

a housing including a first opening, a second opening communicating with the first opening, a first portion surrounding the mixed-flow fan in a circumferential direction, a second portion surrounding the permanent magnet synchronous motor in the circumferential direction, and a third portion provided between the first portion and the second portion;

a first path formed between the first portion and the air blowing unit and to allow the air to flow in a first direction;

a second path formed between the third portion and the guide portion and to allow the air to flow in the second direction; and a third path formed between the second portion and the permanent magnet synchronous motor and to allow the air to flow in a third direction, wherein the permanent magnet synchronous motor includes a guide portion provided inside the third portion in a radial direction and to guide the air in a second direction, and an inner diameter of the second portion is smaller than an inner diameter of the first portion, wherein a width of the third path in a direction perpendicular to the third direction is larger than a width of the second path in a direction perpendicular to the second direction.

16. The electric blower according to claim 15, wherein the third portion is formed integrally with the first portion and the second portion.

17. The electric blower according to claim 15, wherein the permanent magnet synchronous motor includes:

a motor frame;

a stator fixed inside the motor frame; and a rotor inserted inside the stator, and wherein the motor frame includes a through hole through which the air passes.

18. A vacuum cleaner comprising:

the electric blower according to claim 15 to produce suction force; and a dust chamber in which dust sucked up by the suction force is collected.

19. A hand drying device comprising:

a casing including an air inlet and an air outlet; and the electric blower according to claim 15 fixed in the casing, and to suck up air exterior to the casing through the air inlet and send the air outside the casing through the air outlet.

* * * * *